US006390185B1

(12) United States Patent
Proeschel

(10) Patent No.: US 6,390,185 B1
(45) Date of Patent: May 21, 2002

(54) ANNULAR FLOW CONCENTRIC TUBE RECUPERATOR

(76) Inventor: Richard A. Proeschel, 414 Pepperwood Ct., Thousand Oaks, CA (US) 91360

( * ) Notice: Subject to any disclaimer, the term of this patent is extended or adjusted under 35 U.S.C. 154(b) by 0 days.

(21) Appl. No.: 09/799,927

(22) Filed: Mar. 6, 2001

(51) Int. Cl.[7] ..... F28D 7/10
(52) U.S. Cl. ..... 165/155; 165/141; 165/154
(58) Field of Search ..... 165/154, 156, 165/155, 135, 144, 141

(56) References Cited

U.S. PATENT DOCUMENTS

| | | | | | |
|---|---|---|---|---|---|
| 661,110 | A | * | 11/1900 | Schwerdfeger et al. | 165/155 |
| 2,549,687 | A | * | 4/1951 | Jack et al. | 165/156 X |
| 2,847,193 | A | * | 8/1958 | Carter | 165/155 X |
| 4,168,745 | A | * | 9/1979 | Lastinger | 165/135 X |
| 4,204,573 | A | | 5/1980 | Clark | |
| 4,254,826 | A | | 3/1981 | Adams | 165/155 X |
| 4,440,217 | A | | 4/1984 | Stieler | |
| 4,545,334 | A | * | 10/1985 | Nakagawa et al. | 165/154 X |
| 4,778,002 | A | * | 10/1988 | Allgauer et al. | 165/154 X |
| 4,834,172 | A | * | 5/1989 | Duran | 165/155 X |
| 4,862,955 | A | * | 9/1989 | Itakura | 165/155 |
| 4,883,117 | A | | 11/1989 | Dobbs et al. | |
| 4,893,670 | A | * | 1/1990 | Joshi et al. | 165/164 X |
| 5,107,919 | A | * | 4/1992 | Basseen et al. | 165/155 X |
| 5,143,151 | A | * | 9/1992 | Pain | 165/154 |
| 5,388,398 | A | | 2/1995 | Kadambi et al. | |
| 5,725,051 | A | | 3/1998 | Veltkamp | |
| 5,894,729 | A | | 4/1999 | Proeschel | |
| 5,983,992 | A | | 11/1999 | Child et al. | |
| 6,012,514 | A | | 1/2000 | Swain | 165/154 |
| 6,115,919 | A | | 9/2000 | Oswald et al. | |

FOREIGN PATENT DOCUMENTS

| | | | | |
|---|---|---|---|---|
| DE | 172259 | * | 6/1906 | 165/155 |
| DE | 1776175 | * | 3/1971 | 165/155 |
| FR | 2552216 | * | 3/1985 | 165/154 |
| NL | 7802258 | * | 9/1979 | 165/156 |
| WO | 02125 | * | 4/1987 | 165/154 |

* cited by examiner

*Primary Examiner*—Leonard Leo

(57) ABSTRACT

An annular flow concentric tube heat exchanger for heating two counter flowing fluid streams has been devised. Although capable of heating gases or liquids, the primary purpose of the invention is to function as an improved recuperator for recovering exhaust heat from a Brayton Cycle gas turbine engine, Ericsson Cycle engine or similar recuperated engine. The basic element of the recuperator is a concentric tube assembly that, in the preferred embodiment, is comprised of four concentric tubes that enclose three concentric annular flow passages. The low pressure exhaust flows through the inner and outer annular passages while the high pressure compressor exit air flows through the annular passage that is between the two low pressure passages. The high and low pressure flows are in opposite directions to achieve the high effectiveness that is only available with a counterflow heat exchanger. Heat is transferred from the exhaust gas to the compressor air though the tube walls on each side of the high pressure passage. Two low pressure passages are provided for each high pressure air passage to compensate for the lower pressure (and therefore lower density) of the exhaust gas. Multiple concentric tube assemblies are used to make a recuperator. The tube assemblies terminate in header assemblies located at each end of the concentric tube assemblies. The headers are made of simple plates and rings that serve the dual function of structurally locating the concentric tube assemblies and directing the flow to the proper passage in the concentric tube assemblies. High and low pressure flow tubes provide flow passages connecting the recuperator to the engine compressor air and exhaust tubing respectively. The annular flow concentric tube recuperator can be easily made from commercial tubing with minimal special tooling and is capable of very high effectiveness with very low pressure drop.

3 Claims, 48 Drawing Sheets

ANNULAR FLOW CONCENTRIC TUBE RECUPERATOR

BACKGROUND OF THE INVENTION

1. Field of the Invention

This invention relates in general to concentric tube heat exchangers. More particularly, it relates to an improved recuperator for recovering exhaust heat from a Brayton Cycle gas turbine engine, Ericsson Cycle engine, or similar recuperated engine.

2. Description of Prior Art

The thermodynamic efficiency and resulting fuel economy of a gas turbine (Brayton Cycle) engine can be greatly increased by using an exhaust gas heat exchanger to recover heat from the low pressure exhaust stream to preheat the high pressure air between the compressor and combustor. The heat thus recovered in the preheating process, which would otherwise be wasted in the exhaust, does not have to be supplied by the combustor. As a result, the cycle efficiency is typically doubled from about 15% without a heat exchanger to 30% with a heat exchanger. Newer types of engines, such as the Afterburning Ericsson Cycle of my U.S. Pat. No. 5,894,729 (1999), make even better use of an exhaust gas heat exchanger and can achieve cycle efficiencies of over 40%.

There are two types of exhaust gas heat exchangers: recuperators and regenerators. Although the names are frequently used interchangeably, a recuperator usually refers to a heat exchanger where the high pressure compressor flow and the low pressure exhaust flow are continuously separated by walls and the heat transfer takes place through those walls. A regenerator usually refers to a heat exchanger where the same walls are alternately exposed to the high and low pressure flows. Although a regenerator is usually smaller than a comparable recuperator, the seals and moving parts needed for the flow switching causes mechanical complexity, flow leakage, lower heat recovery and higher cost. Therefore, recuperators are becoming the preferred type of exhaust gas heat exchanger.

A recuperator has requirements that are unique from other types of heat exchangers. First, it must be able to capture the maximum percentage of the available exhaust heat (have high effectiveness). The higher the effectiveness, the more efficient the engine becomes. However, high effectiveness generally requires more pressure drop in both the high pressure compressor outlet flow and the low pressure exhaust flow. The flow work represented by these pressure drops reduces the engine efficiency and can offset the gain from a higher effectiveness. Therefore, the pressure drop through the recuperator must be maintained as low as possible while still obtaining the highest thermal effectiveness. In addition, the recuperator should be easily and economically fabricated, be able to withstand the pressure load from the high pressure flow, allow for thermal growth during heating and cooling transients, be tolerant of fouling from exhaust products, and be capable of withstanding high exhaust temperatures.

Prior art recuperators have compromised one or more of those requirements. The most common approach has been to use a plate-fin heat exchanger. This type of recuperator is generally made of flat sheets interleaved with corrugated sheets that are furnace brazed or welded together. A leading prior art plate-fin heat exchanger is documented in U.S. Pat. No. 5,983,992 (1999). This type of recuperator can attain fairly high effectiveness but is expensive to make because of the large number of parts, many of which are thin wall plates subject to damage during manufacture. Furthermore, since recuperators operate at temperatures where creep strength is low, the pressure loads from the high pressure side can cause the thin plates to distort and shorten the life of the recuperator. Finally, the large number of highly stressed welds increases manufacturing cost and provides potential locations for failure and leakage.

The U.S. Army M1A1 main battle tank is powered by a gas turbine having an annular plate recuperator and is described in U.S. Pat. No. 5,388,398 (1995). This recuperator consists of many annular plates that are also very complex to manufacture and maintain leak free.

The spiral recuperator has been developed in an effort to avoid the complexity of plate type heat exchangers while also using the curved surfaces to hold pressure with less material stress. U.S. Pat. No. 4,883,117 (1989) proposes a typical spiral type recuperator. Spiral recuperators have a significant problem with thermal "short circuiting" that prevents them from achieving high thermal effectiveness. The spiral path puts cold fluid and warm fluid in the same flow in direct or close contact and causes the flow to have a driving potential to become the same temperature. Since the objective is to obtain the maximum temperature difference between the inlet and outlet, the "short circuit" effect can greatly reduce the thermal effectiveness.

A recent advance in spiral recuperators is the Rolls-Royce heat exchanger of U.S. Pat. No. 6,115,919 (2000). Although of spiral construction, both the high and low pressure flows are true counterflow and run along the axis of the spiral with no possibility for "short circuits". The recuperator is intended for mass production by being formed of continuous strips that are rolled in a spiral to form the recuperator. Nevertheless, the recuperator is still quite complex and requires many welds of thin material at the header holes and sheet edges. The manufacturing cost will remain high due to the number of complex welds and the need to accurately align the spiral sheets. As with the plate-fin heat exchanger, the weld joints are always a potential location for failure and leakage.

The previously described recuperators make use of corrugated surfaces, wavy surfaces, fins or similar devices to increase turbulence and heat transfer. These devices are indeed effective in raising effectiveness, but they also increase pressure drop. It has been common practice in compact heat exchanger design to operate in the turbulent flow range and to avoid laminar flow. However, with small hydraulic diameters, significant heat transfer coefficients can be achieved with laminar flow. Just as important, with laminar flow, the overall heat transfer rate can be increased while the pressure drop is decreased. This is because the heat transfer coefficient in laminar flow is dependent only on passage geometry and not on the flow velocity. Additional flow paths can be added to proportionately increase the overall heat transfer conductance while at the same time proportionately decreasing the pressure drop. This characteristic is exactly what is needed for a high performance recuperator.

U.S. Pat. No. 5,725,051 (1998) describes a heat exchanger that is successfully used as a laminar flow recuperator. Although not currently used as an engine recuperator, a plastic version used in home ventilation systems achieves 94% effectiveness with a pressure drop of only 0.16 inch of water. The recuperator allows fresh outside air to be exchanged with inside air with only a 6% of the un-recuperated air conditioning or heating load. The disadvantage of this heat exchanger is that it has a very complex header system to distribute the two streams to their respective heat exchange flow paths.

Concentric tube heat exchangers are used frequently in applications other than recuperators. Although possessing the advantage of being able to use simple tubular construction, prior art concentric tube heat exchangers have had several limitations for use as recuperators. U.S. Pat. No. 6,012,514 (2000) is a simple concentric tube heat exchanger that is easy to manufacture and maintain. However, it uses gasketed construction that is not suitable for the high temperatures and pressures of a recuperator. More importantly, like other concentric tube heat exchangers such as in U.S. Pat. No. 4,204,573 (1980), U.S. Pat. No. 4,254,826 (1981), and U.S. Pat. No. 4,440,217 (1984), only two tubes are used in the concentric tube assemblies. With this arrangement, one flow passage is within the circular passage of the center tube and the other is in the annular region between the center and outer tube. It is difficult to achieve high rates of heat transfer into the center tube, particularly if attempting to achieve low pressure drop by using laminar flow.

It is the primary aim of this invention to overcome the disadvantages of current engine exhaust gas recuperators discussed above and to achieve high thermal effectiveness, low pressure drop, long life, and economy of manufacture by implementing the several objects listed below.

Objects of the Invention

It is an object of this invention to provide a recuperator attaining a minimum of 90% effectiveness with reasonable size and cost.

To attain the high effectiveness it is an object to have linear, counterflow, flow paths to prevent any potential for thermal "short circuits".

To attain the high effectiveness it is an object to minimize the losses due to axial conduction in the recuperator.

To attain the high effectiveness it is an object to define methods to account for, minimize and accommodate effectiveness loss due to flow misdistribution and manufacturing tolerances.

To attain the high effectiveness it is an object to have an easily insulated recuperator to minimize ambient heat loss.

It is another object to minimize the pressure drop through both the high pressure and low pressure sides of the recuperator.

It is also an object to have sufficient margin to accommodate exhaust gas fouling of the low pressure flow passages.

It is a further object to be able to use lower cost materials at their upper limits of strength and creep resistance by using only cylindrical or stayed surfaces to minimize material stress.

It is a yet a further object to avoid inducing thermal gradient stresses by having all non-isothermal portions of the recuperator able to freely expand and contract.

It is still another object to define a method of construction that requires no special tooling or manufacturing processes.

It is another object to minimize the construction cost by being able to use commercially available tubing materials as the primary heat transfer passages.

SUMMARY OF THE INVENTION

To implement the stated objects of the invention, an annular flow, concentric tube, counterflow recuperator has been devised and a novel method of manufacturing the recuperator has been developed. The principal feature of the concentric tube recuperator is that it allows a high performance (high temperature, high effectiveness, low pressure drop) recuperator to be made by simply welding, brazing, or otherwise joining standard commercial tubing with no special tooling. The only parts of the recuperator that are not made from commercial tubing are the header plates, concentric tube assembly spacers, and outside insulation. The header plates can be made by any competent machine shop with no special tooling by simply boring holes in circular plates. The holes do not even have to be accurately located so long as they are concentric between plates with reasonable accuracy. The concentric tube assembly spacers are simple annular pieces that can be stamped, extruded, or made on a lathe. The insulation blankets are also simple to manufacture.

The basic element of the recuperator is a concentric tube assembly that, in the preferred embodiment, is comprised of four concentric tubes that enclose three concentric annular flow passages. The low pressure exhaust flows through the inner and outer annular passages while the high pressure compressor exit air flows through the annular passage that is between the two low pressure passages. The high and low pressure flows are in opposite directions to achieve the high effectiveness that is only available with a counterflow heat exchanger. Heat is transferred from the exhaust gas to the compressor air though the tube walls on each side of the high pressure passage. Two low pressure passages are provided for each high pressure air passage to compensate for the lower pressure (and therefore lower density) of the exhaust gas. The 2/1 flow passage ratio allows close tube gaps to be used to maximize heat transfer while providing a larger low pressure flow area to minimize the pressure drop of the low density exhaust.

Multiple concentric tube assemblies are used to make a recuperator. The tube assemblies terminate in header assemblies located at each end of the concentric tube assemblies. The headers are made of simple plates and rings that serve the dual function of structurally locating the concentric tube assemblies and directing the flow to the proper passage in the concentric tube assemblies. High and low pressure flow tubes provide flow passages connecting the recuperator to the engine compressor air and exhaust tubing respectively.

In the preferred embodiment, the high heat transfer and low pressure drop is accomplished by sizing the number of concentric tube assemblies and the diameters of the tubes in the assemblies to allow the recuperator to operate with laminar flow in both the high and low pressure passages. Operating in the laminar region provides two advantages. First, standard, low cost, commercial tubing can be used to build the concentric tube assemblies. No additional heat transfer enhancement devices such as ribs, fins, spiral wires, or such devices are necessary to promote turbulence. High heat transfer rates are obtained using smooth tubes, spaced closely together. Second, in laminar flow, the heat transfer coefficient is defined solely by the tube spacing within the individual concentric tube assemblies. Additional concentric tube assemblies can then be added in parallel to proportionally increase the heat transfer area (and therefore proportionally increase overall heat transfer rate) while simultaneously proportionally reducing the pressure drop. The laminar flow characteristic of proportionally increasing heat transfer rate while proportionally decreasing pressure drop is the key to meeting the objective of high effectiveness and low pressure drop.

The objective of defining a method of construction that requires no special tooling or manufacturing processes is met by having two types of concentric flow assemblies, a basic concentric tube assembly and a "tooling" concentric flow assembly. The invention provides a method of manufacturing a laminar flow concentric tube recuperator comprising the steps of:

(a) building at least two tooling concentric flow assemblies by spacing the four tubes with annular spacers to form a rigid assembly.

(b) manufacturing four header plates for each end such that each plate has a number of holes corresponding to the number of concentric tube assemblies, with the hole diameters on each plate corresponding to the outside diameter of a corresponding tube in the concentric tube assembly, and concentric locations of the corresponding holes in all four plates.

(c) attaching a header plate with the largest holes to each of the tooling concentric flow assemblies.

(d) attaching the largest tubes of the basic concentric tube assemblies to the header plates from step (c).

(e) attaching a header ring to each of the header plates from step (c).

(f) attaching a header plate with the second largest holes to each of the tooling concentric flow assemblies and to the header rings from step (e).

(g) attaching the second largest tubes of the basic concentric tube assemblies to the header plates from step (f).

(h) attaching a header ring to each of the header plates from step (f) and to the header ring of step (e)

(i) repeating the process until the metal portions of the recuperator are completed.

(j) wrapping the recuperator metal portions with an insulation blanket.

BRIEF DESCRIPTION OF THE DRAWINGS

A better understanding of the invention may be gained by reference to the following Detailed Description in conjunction with the drawings provided in which:

FIG. 1 also shows the counterflow high and low pressure flow paths.

REFERENCE NUMBERS IN THE DRAWINGS

Figure 1:
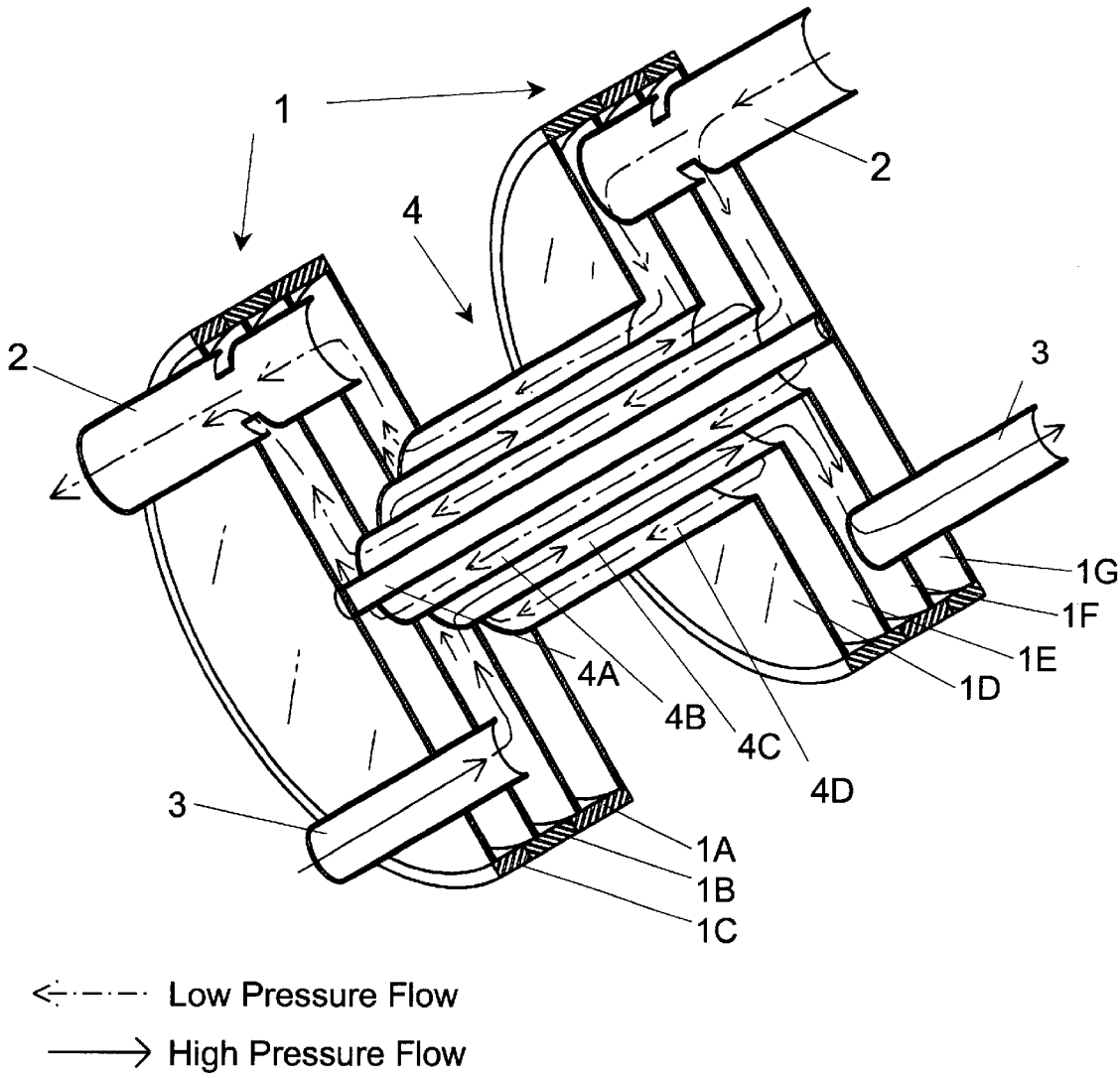
FIG. 1 is a cross section of a simplified annular flow concentric tube recuperator showing a single concentric tube assembly, header assemblies, and high and low pressure flow tubes.

| | |
|---|---|
| 1 | Header Assembly |
| 1A | Inner Low Pressure Ring |
| 1B | High Pressure Ring |
| 1C | Outer Low Pressure Ring |
| 1D | Inner Low Pressure Plate |
| 1E | Inner High Pressure Plate |
| 1F | Outer High Pressure Plate |
| 1G | Outer Low Pressure Plate |
| 2 | Low Pressure Flow Tube |
| 3 | High Pressure Flow Tube |
| 4 | Basic Concentric Tube Assembly |
| 4A | Center Low Pressure Tube |
| 4B | Inner Heat Exchange Tube |
| 4C | Outer Heat Exchange Tube |
| 4D | Outer Low Pressure Tube |
| 4E | Center Tube Plug |
| 5 | Tooling Concentric Tube Assembly |
| 5A | Center Low Pressure Tube |
| 5B | Inner Heat Exchange Tube |

-continued

| REFERENCE NUMBERS IN THE DRAWINGS | |
|---|---|
| 5C | Outer Heat Exchange Tube |
| 5D | Outer Low Pressure Tube |
| 5E | Center Tube Plug |
| 5F | Outer Low Pressure Spacer |
| 5G | High Pressure Spacer |
| 5H | Inner Low Pressure Spacer |
| 6 | Insulation Assembly |
| 6A | Insulation Cylinder |
| 6B | Insulation End Cap |

DETAILED DESCRIPTION OF THE PREFERRED EMBODIMENTS PARTS OF THE INVENTION

The basic components of the annular flow concentric tube recuperator are shown in the simplified cross-section of FIG. 1. The recuperator consists of two substantially identical header assemblies 1, two substantially identical low pressure flow tubes 2, two substantially identical high pressure flow tubes 3, and multiple concentric tube assemblies 4, of which, for drawing simplicity, only one is shown in FIG. 1. In the preferred embodiment, the concentric tube assemblies 4 are comprised of four tubes 4A, 4B, 4C and 4D that form the boundaries for three concentric annular flow paths. As the coded arrows show, the inner and outer flow paths are used for the low pressure flow and the high pressure flow path lies between the low pressure paths. The header assemblies 1, are each made from three tubular rings 1A, 1B, 1C and four circular plates 1D, 1E, 1F, and 1G. The rings and plates form cylindrical manifold regions to distribute the flow from the high and low pressure flow tubes 2 and 3 to the concentric tube assemblies 4.

Figure 2:
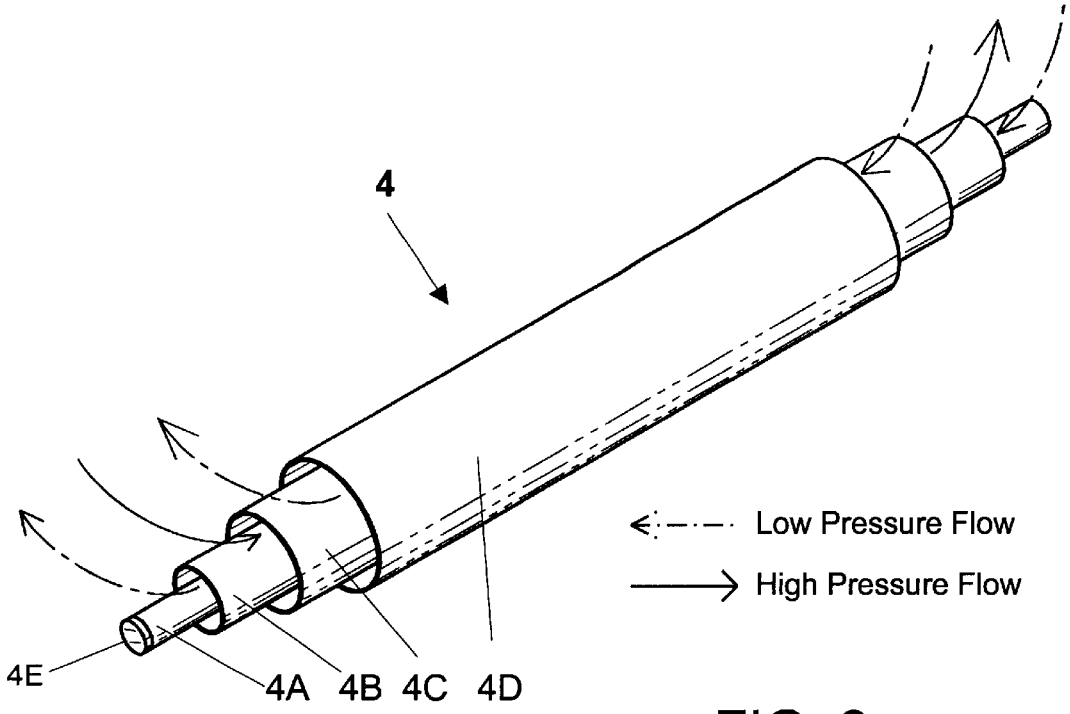
FIG. 2 shows a basic concentric tube assembly and the counterflow high and low pressure flow paths.

FIG. 2 shows a basic concentric tube assembly 4 and its component parts. The central tube 4A, is closed by a plug 4E, to prevent convection between the center tube and the outside air.

Figure 3:
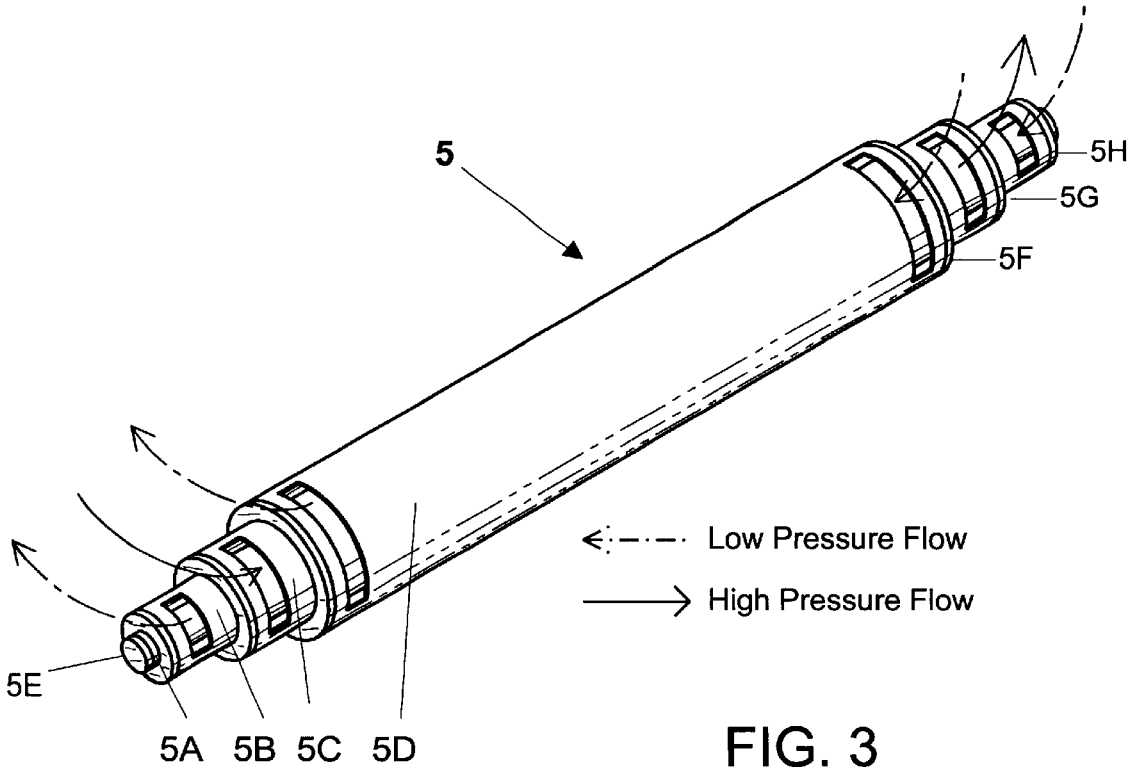
FIG. 3 shows a tooling concentric tube assembly and the counterflow high and low pressure flow paths.

FIG. 3 shows a tooling concentric tube assembly 5 and its component parts. At least two tooling concentric tube assemblies are needed to provide the concentric datums for the header plates that assure the basic concentric tube assemblies are also concentric. The flow passages in the tooling concentric tube assemblies are identical to those in the basic concentric tube assemblies except that flow enters and leaves the annular flow passages through slots or holes in the sides of tubes 5B, 5C, and 5D rather than through the open ends of the tubes. The tube ends are closed by spacers 5F, 5G and 5H that are pressed into the tubes to hold them concentric.

Figure 4:
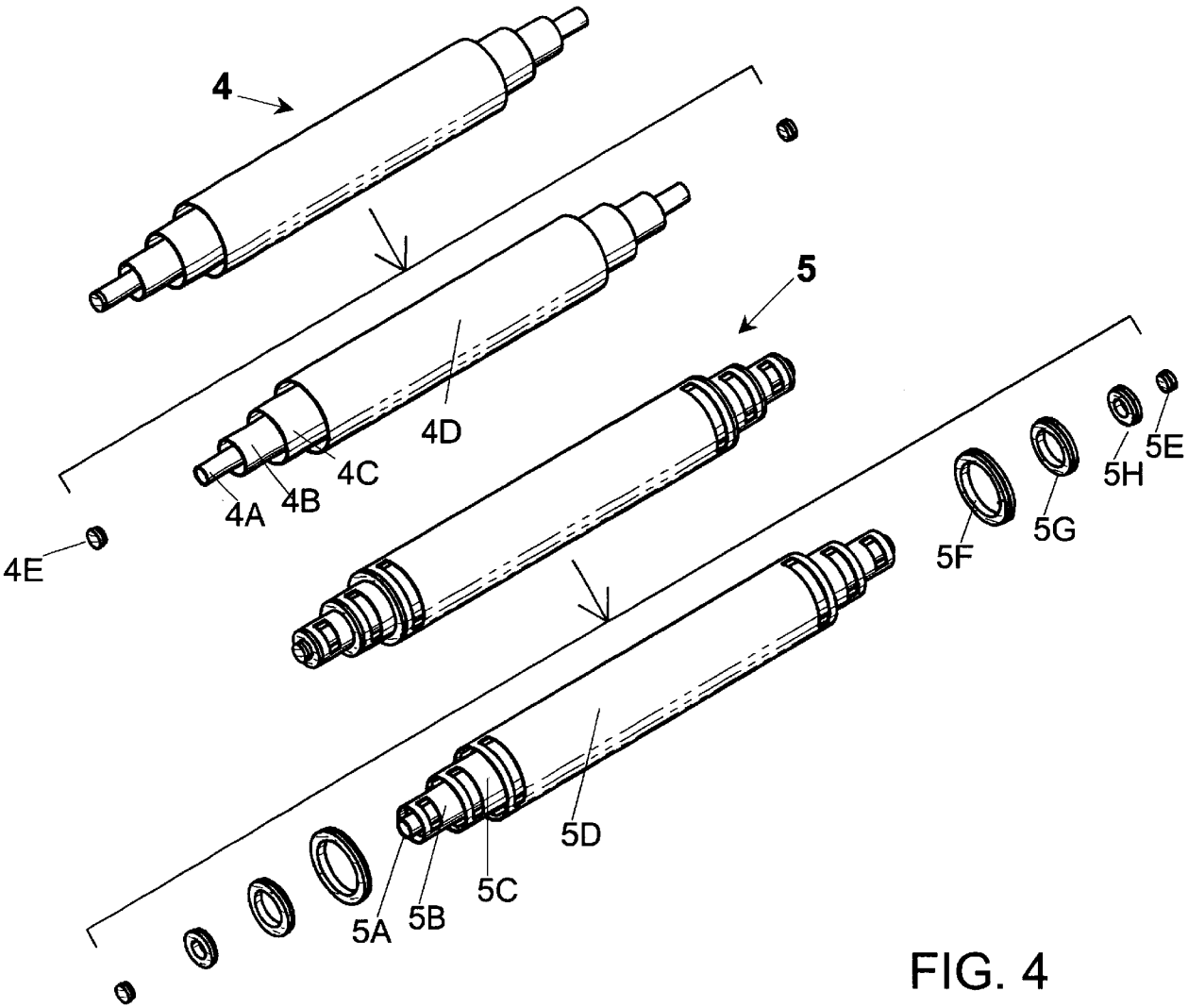
FIG. 4 shows exploded views of a basic concentric tube assembly and a tooling concentric tube assembly.

The parts of the two types of concentric tube assemblies are shown in exploded views in FIG. 4.

Figure 6:
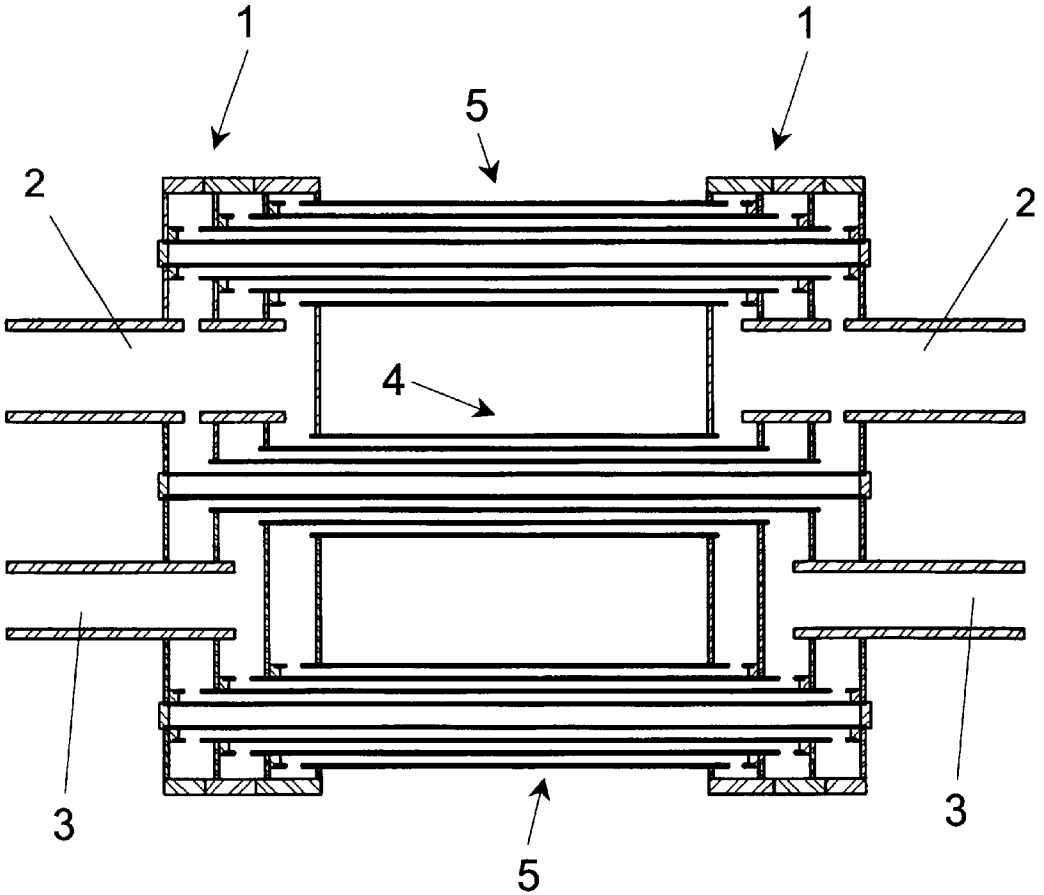
FIG. 6 shows a cross section of the recuperator with insulation removed.
Figure 5:
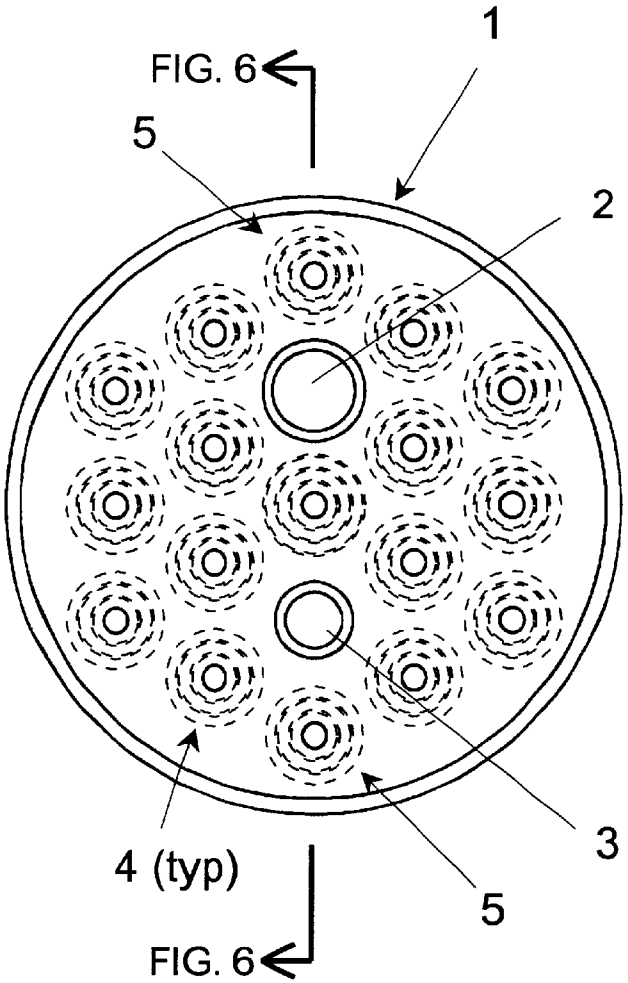
FIG. 5 shows an end view of the recuperator with insulation removed.
Figure 7:
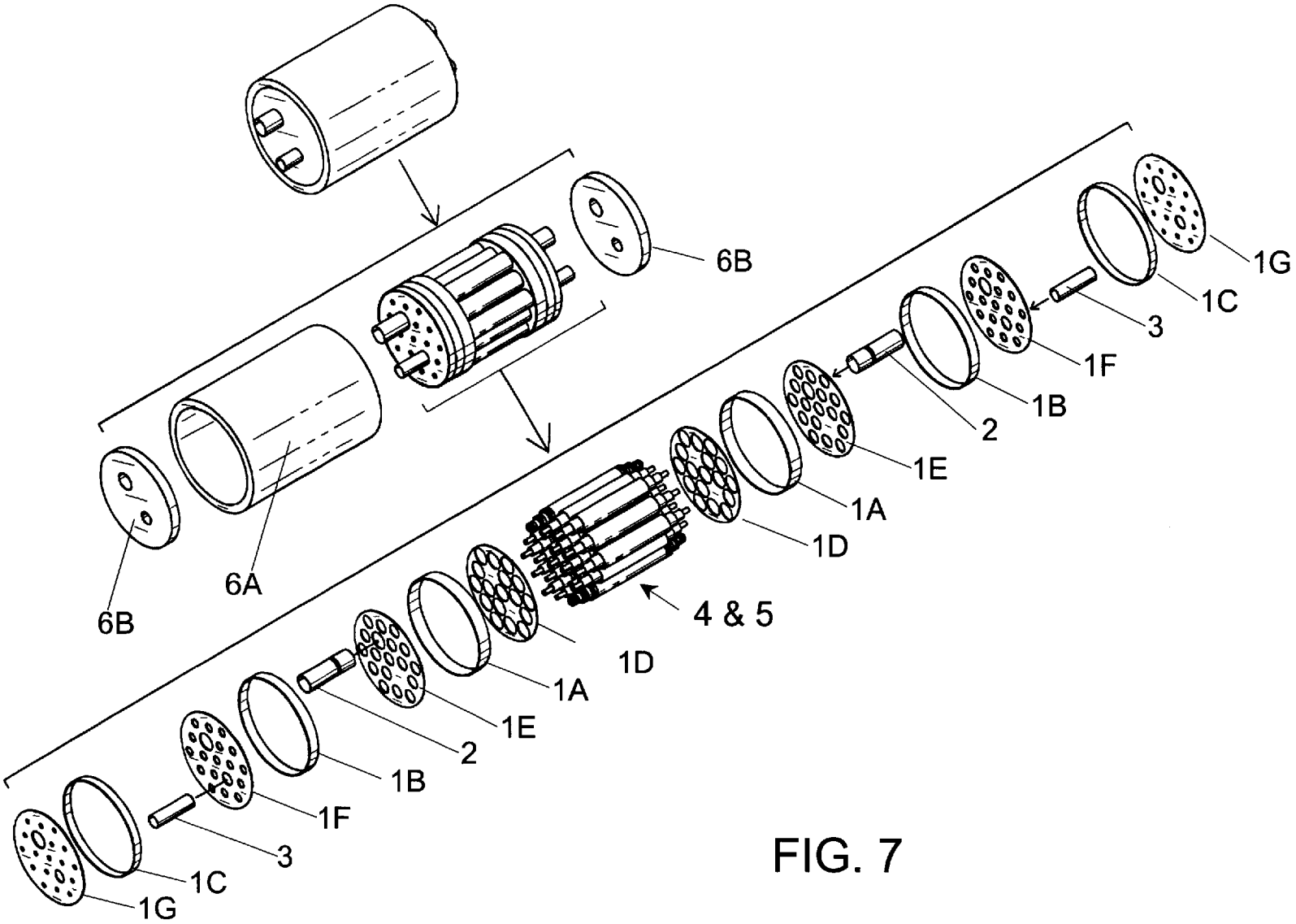
FIG. 7 shows an exploded view of the recuperator.

FIG. 5 and FIG. 6 show how the parts of the recuperator are assembled. The cross section of FIG. 6 cuts through the two tooling concentric tube assemblies 5 and shows how they align the headers 1 that, in turn, align the basic concentric tube assemblies 4. An overall exploded view showing all the parts of the recuperator is shown in FIG. 7.

The recuperator's construction provides a robust assembly that minimizes pressure stresses in the parts. With the exception of the header plates, all the pressure barriers are cylinders and carry the stress as hoop stresses. The header plates also have low pressure stresses because the pressure loads are taken by the concentric tube assemblies and flow tube assemblies that act in the same manner as boiler stays. Thermal stresses are virtually eliminated because the only thermal gradients are along the axes of the concentric tube assemblies and the entire assembly is free to expand and contract.

The tubular and plate structure of the annular flow concentric tube recuperator is made from stainless steel, high temperature alloy, ceramic or other material capable of withstanding the design temperatures and pressures. Consideration should be given to oxidation resistance and creep strength as well as thermal and stress properties. In general, the material selected should be the lowest cost material suitable for the design conditions.

Figure 8:
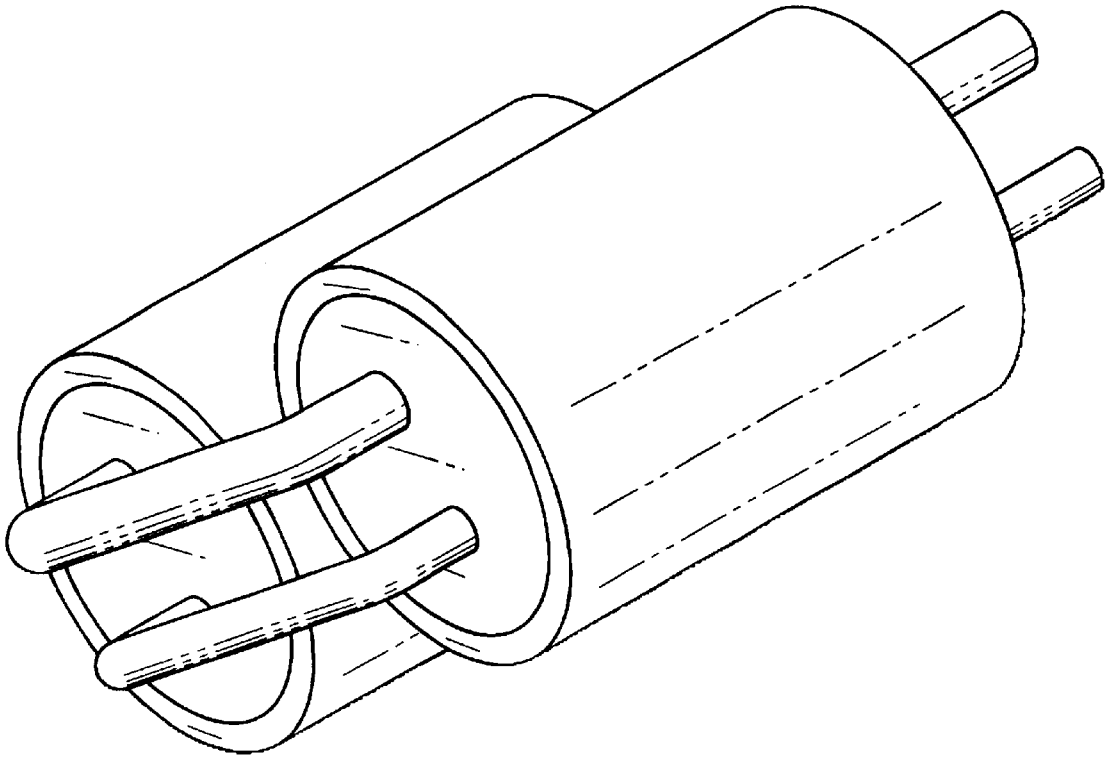
FIG. 8 shows two recuperators in series.

The insulation should be selected based on thermal conductivity, temperature range, ability to withstand expected environments (particularly moisture and vibration), and cost. At the present time, REFRASIL silica/alumina fiber insulation is an excellent choice.

Where the length of the recuperator cannot fit into a required location, the recuperator can be made of two smaller recuperators in series as shown in FIG. 8. Although this has packaging advantages, there is a performance loss that will be discussed in a later section of this application.

METHOD OF MANUFACTURING THE INVENTION

Figures 9A, 9B, 9C:
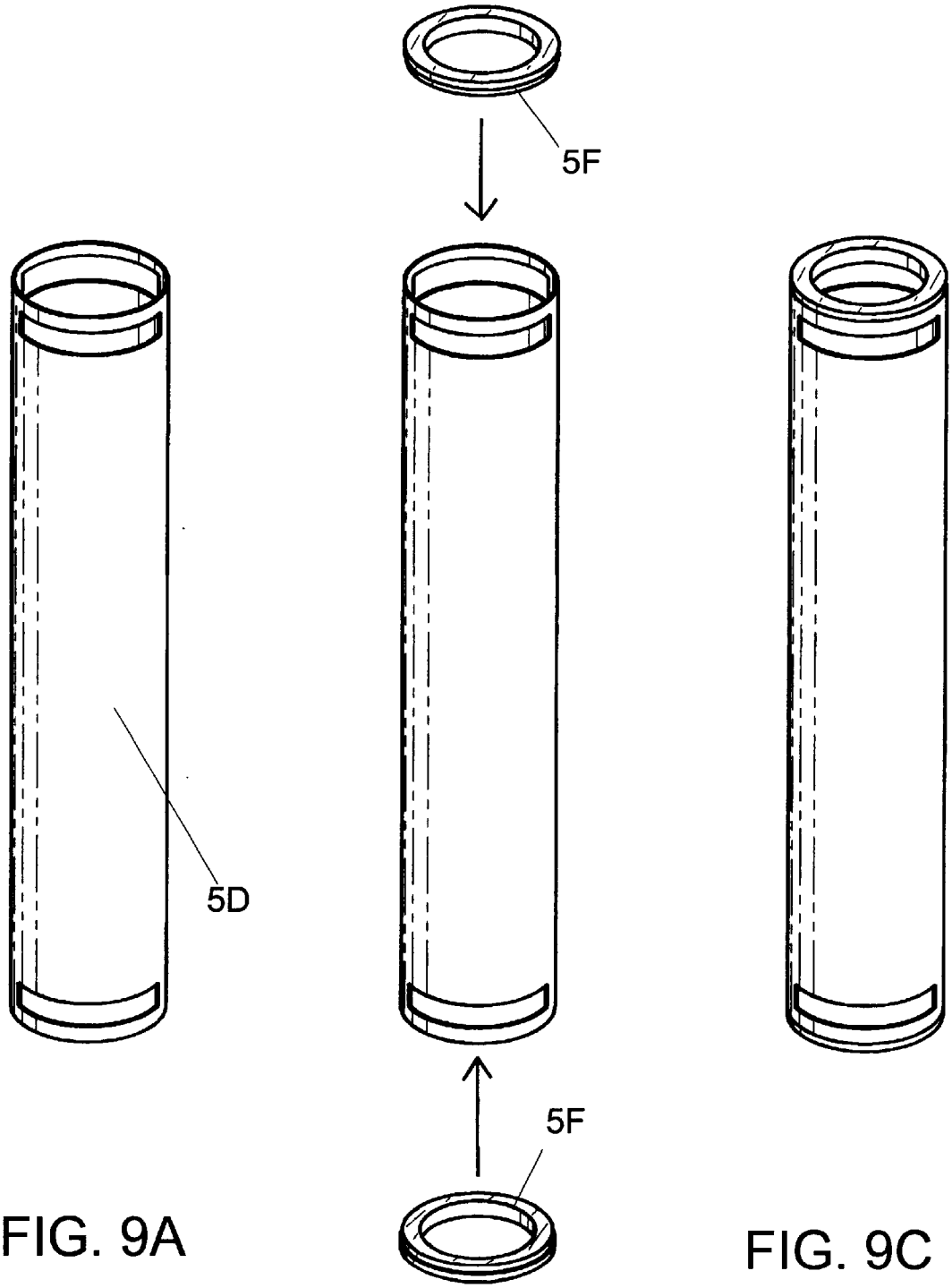
FIGS. 9A through 9P show the assembly sequence for a tooling concentric tube assembly.

The simple means by which the recuperator can be manufactured are shown in FIG. 9A through FIG. 10AE. Manufacturing begins by building the two tooling concentric tube assemblies. The steps in making each tooling concentric tube assembly consists of the following operations:

The first step, FIG. 9A and FIG. 9B, is to cut and slot an outer low pressure tube 5D and then fit each end of tube 5D with outer low pressure spacers 5F to form the subassembly of FIG. 9C. The spacers 5F can be attached to the tube 5D by a simple press fit, tack weld, brazing, or other appropriate means. There is no pressure load on any of the spacers so the general requirement for attaching the spacers is to accurately and rigidly join the tubes and spacers rather than to provide a high strength or leak free joint.

Figure 9D:
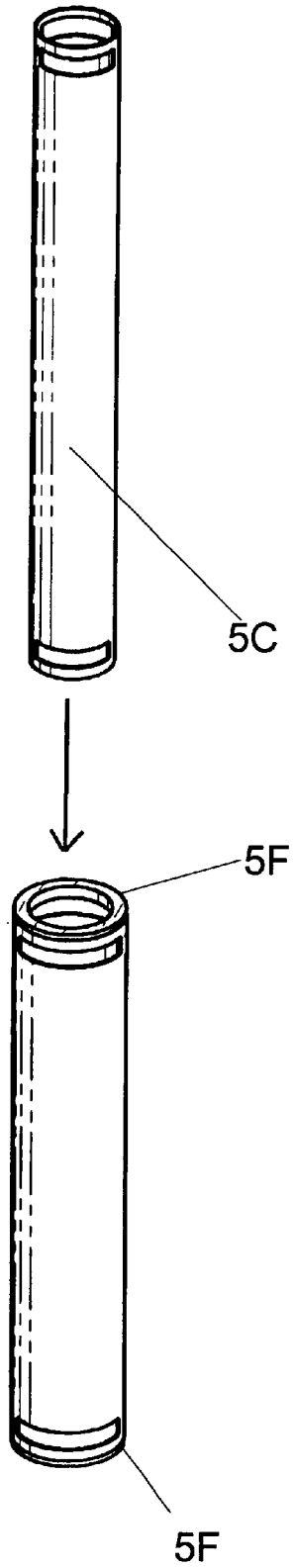
Figure 9E:
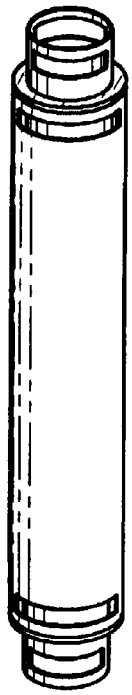
Figure 9F:
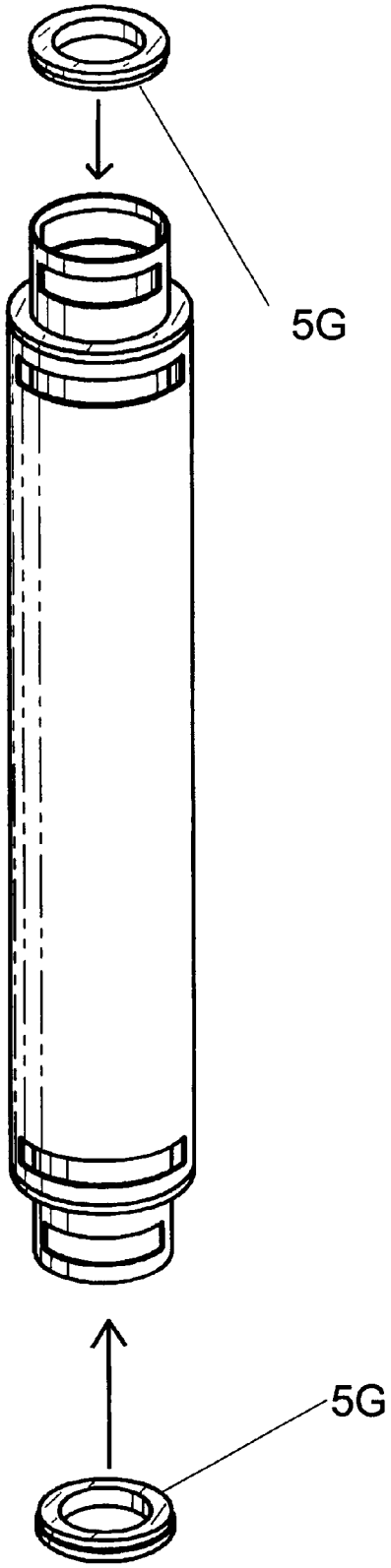

An outer heat exchange tube 5C is then cut to length, slotted and inserted as shown in FIG. 9D to make the subassembly of FIG. 9E. Again, the joint between tube 5C and spacer 5F is based more on accuracy and rigidity than leakage or strength.

Figure 9G:
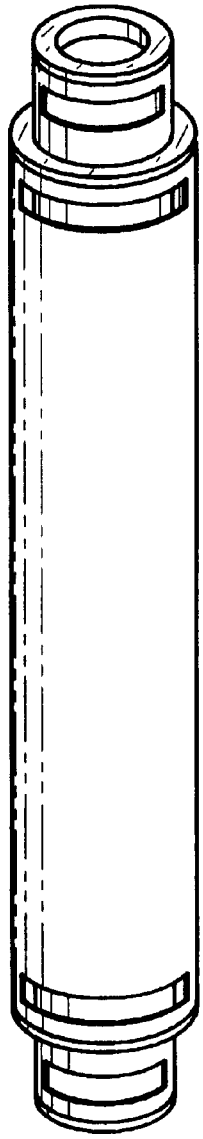

High pressure spacers 5G are next fitted (FIG. 9F) into the subassembly from FIG. 9E as to make the subassembly of FIG. 9G.

Figure 9H:
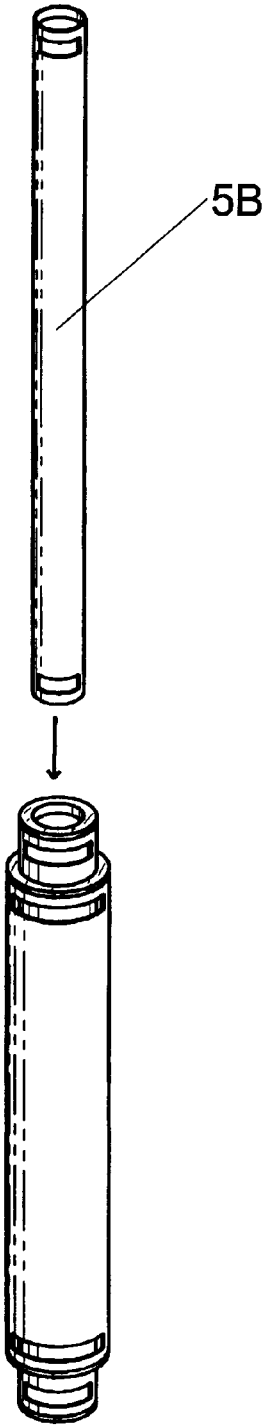
Figure 9I:
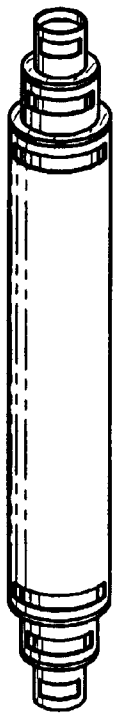
Figure 9J:
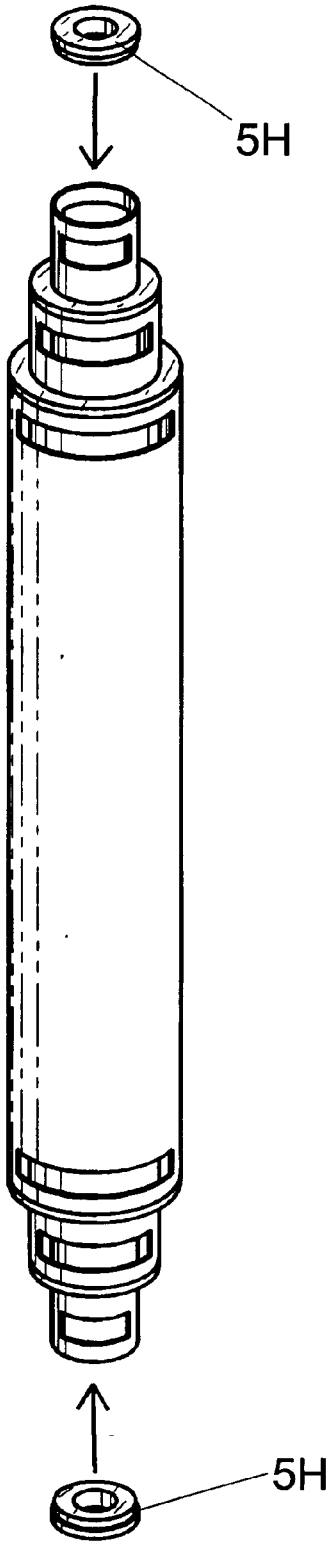
Figure 9K:
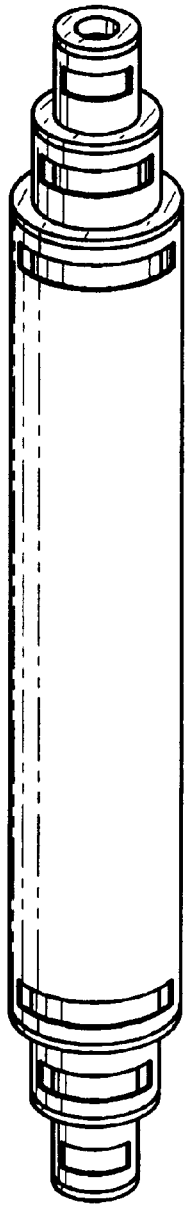

An inner heat exchange tube 5B is then cut to length, slotted and inserted as shown in FIG. 9H to make the subassembly of FIG. 9J.

Figure 9L:
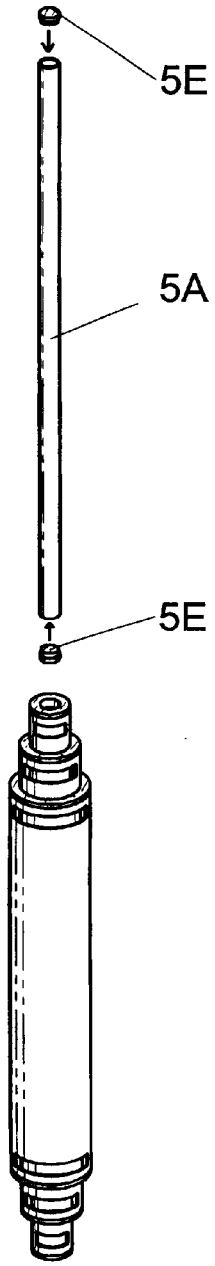
Figure 9M:
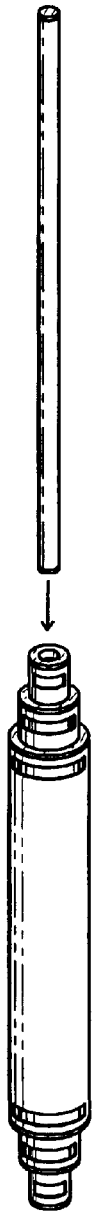

Inner low pressure spacers 5H are next fitted (FIG. 9K) into the subassembly from FIG. 9J as to make the subassembly of FIG. 9L.

Figure 9N:
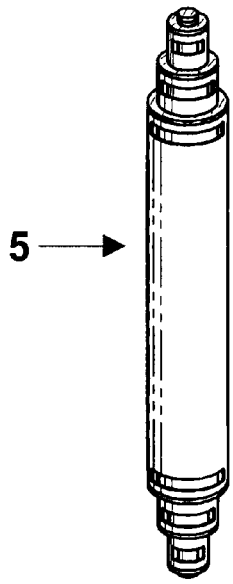

A center low pressure tube 5A is then cut to length, fitted with center tube plugs 5E (FIG. 9M) and inserted as shown in FIG. 9N to make the completed tooling concentric flow tube assembly 5 assembly of FIG. 9P.

Figure 10C:
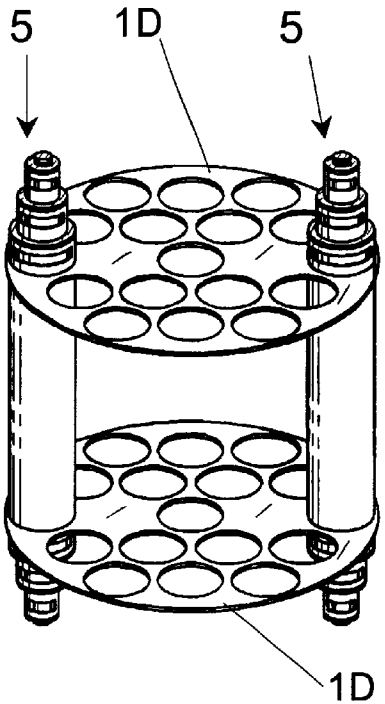
FIGS. 10A through 10AE show the assembly sequence for the recuperator after the tooling concentric tube assemblies are completed.
Figure 10B:
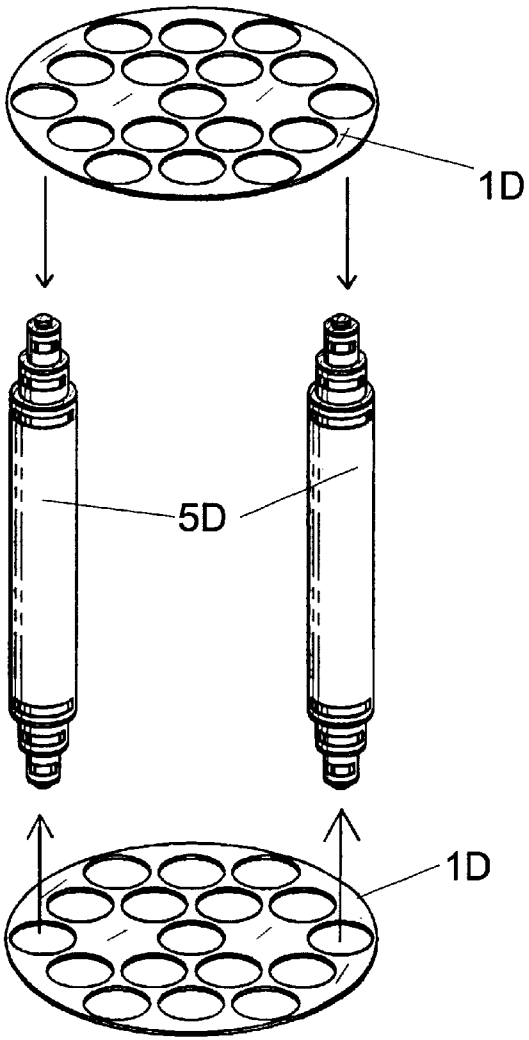

Once the two tooling concentric tube assemblies are completed (FIG. 10A), the remaining manufacturing effort consists of the following steps:

As shown in FIG. 10B, two inner low pressure plates ID are cut out and holes are drilled, bored, or punched to the diameter of the outer low pressure tube 5D. The inner low pressure plates 1D are attached to the outer low pressure tubes 5D to form the subassembly of FIG. 10C. At this point the joint between 1D and 5D is primarily determined by accuracy and rigidity. This joint will eventually need to be pressure and leak resistant but the final joining can wait until the next step where it can be combined with the joining operation there.

The next step (FIG. 10D) is to cut the basic concentric tube assembly outer low pressure tubes 4D to length and insert them into the holes in the subassembly from FIG. 10C. In FIG. 10E, the outer low pressure tubes 4D are attached to the inner low pressure plates 1D by welding, brazing or other appropriate means suitable to provide a pressure and leak resistant joint at the operating temperatures and pressures.

Figure 10A:
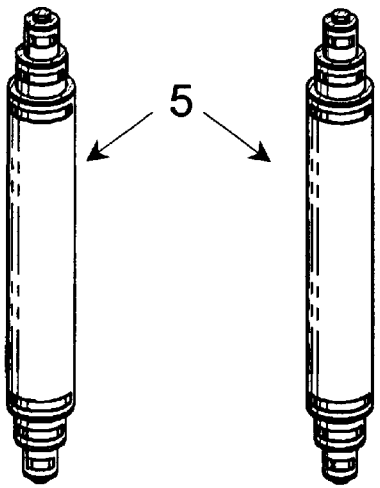
Figure 10D:
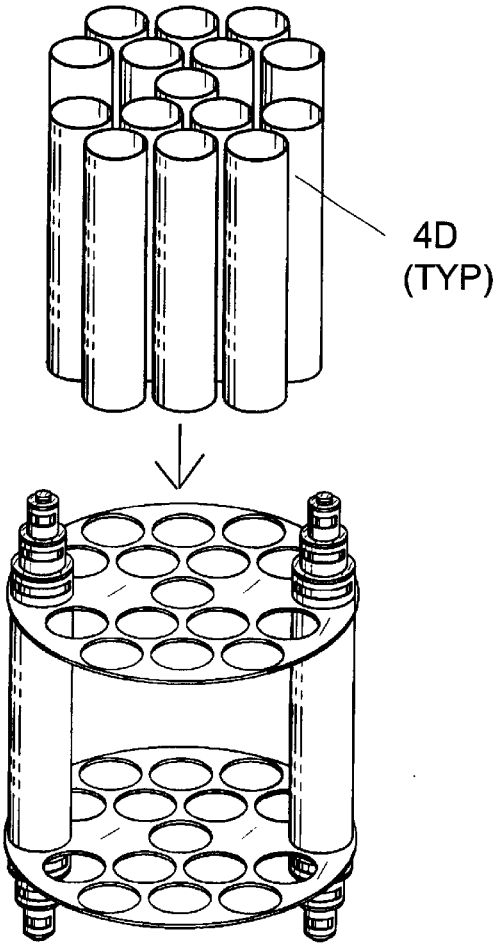
Figure 10E:
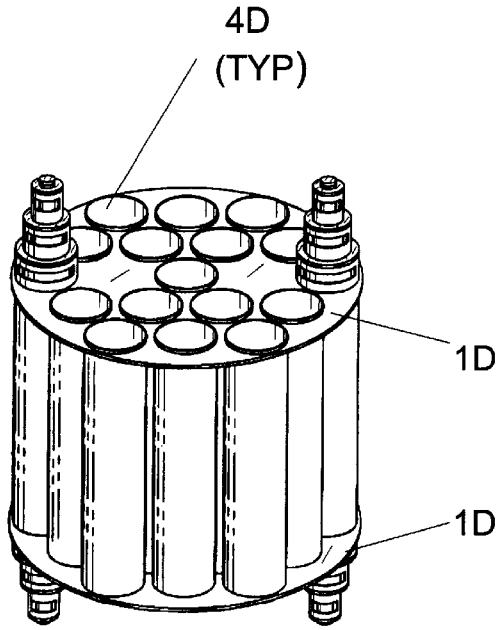
Figure 10F:
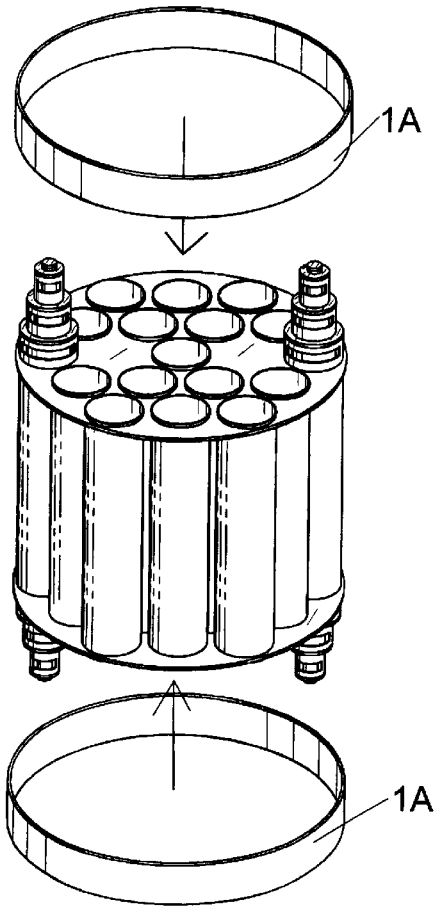
Figure 10G:
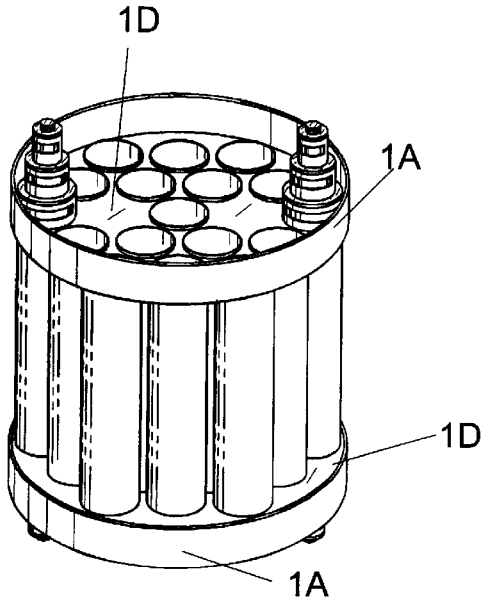
Figure 10J:
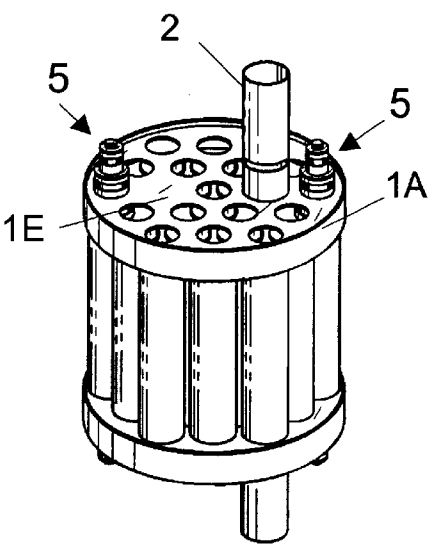
Figure 10I:
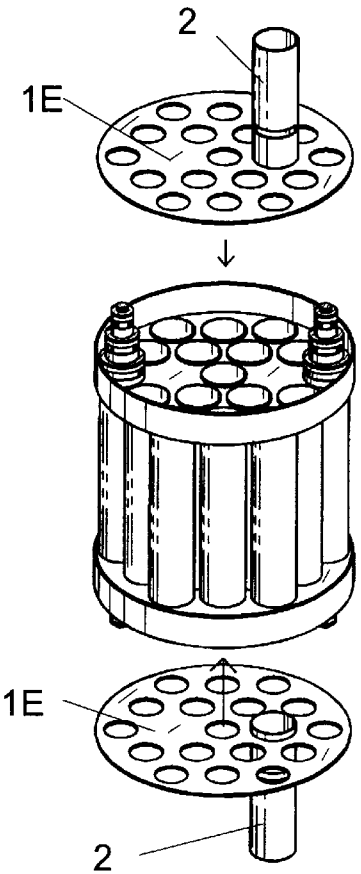

The two inner low pressure rings are cut to length and assembled to the subassembly of FIG. 10E as shown in FIG. 10F. A leak and pressure resistant seal is made (FIG. 10G) between the inner low pressure rings 1A and the inner low pressure plates 1D by welding, brazing or other appropriate means.

Figure 10H:
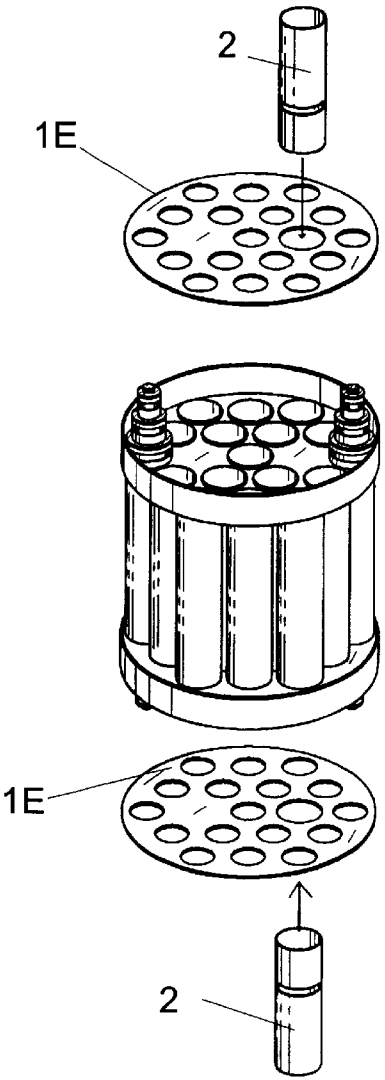

FIG. 10H shows the inner high pressure plate 1E after it has been drilled, bored, or punched to fit the outer heat exchange tube (4C and 5C in FIG. 4) diameter and drilled, bored, or punched to fit the low pressure flow tube. The two low pressure flow tubes 2 are also cut to length and slotted at this point.

Next (FIG. 10J) the two low pressure flow tubes 2 are attached to the inner high pressure plates 1E by welding, brazing or other appropriate means. The resulting subassembly is attached (FIG. 10K) to the tooling concentric tube assemblies 5 and the inner low pressure rings 1A of the subassembly from FIG. 10G. At this point the joint between 1E and 5 is primarily determined by accuracy and rigidity. This joint will eventually need to be pressure and leak resistant but the final joining can wait until the next step where it can be combined with the joining operation there. The joint between 1E and 1A is now made by welding, brazing, or other appropriate means.

Figure 10K:
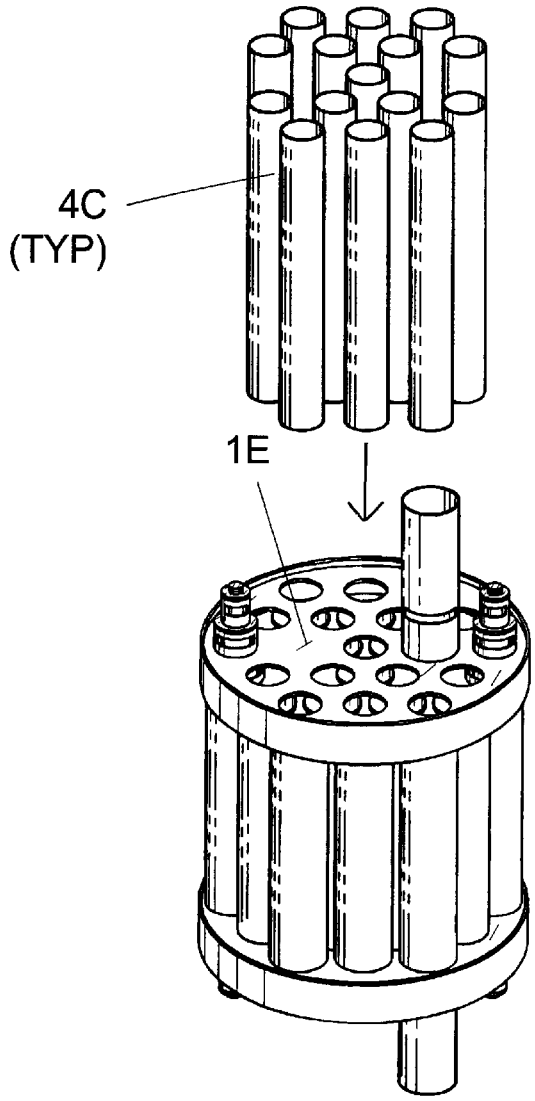
Figure 10L:
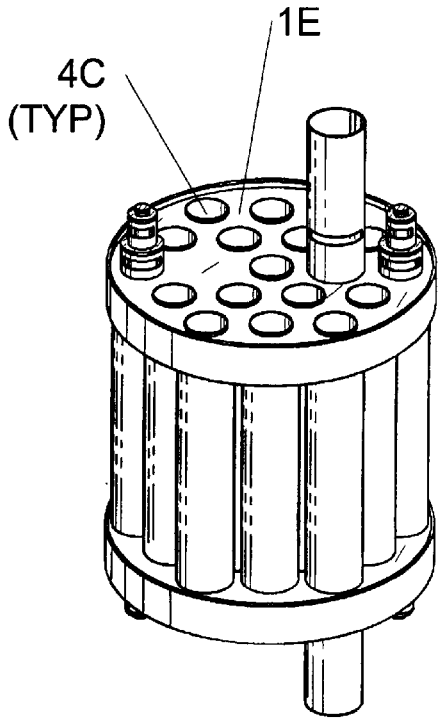
Figure 10O:
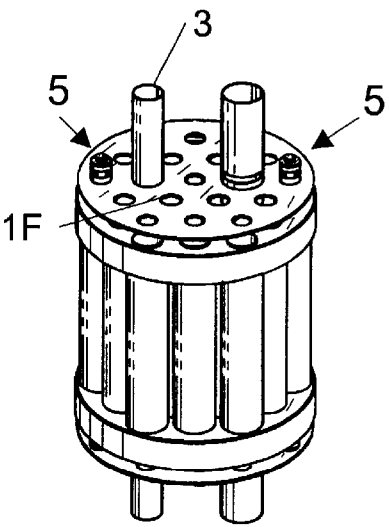

The next step (FIG. 10L) is to cut the basic concentric tube assembly outer heat exchange tubes 4C to length and insert them into the holes in the subassembly from FIG. 10K. In FIG. 10M, the outer heat exchange tubes 4C are attached to the inner high pressure plates 1E by welding, brazing or other appropriate means suitable to provide a pressure and leak resistant joint at the operating temperatures and pressures.

Figure 10N:
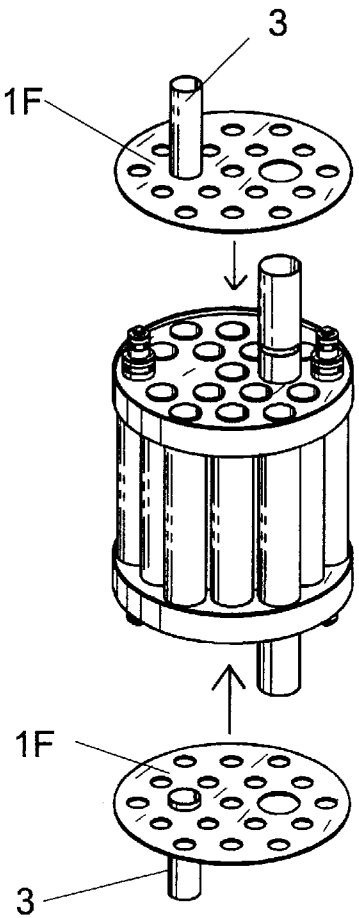
Figure 10M:
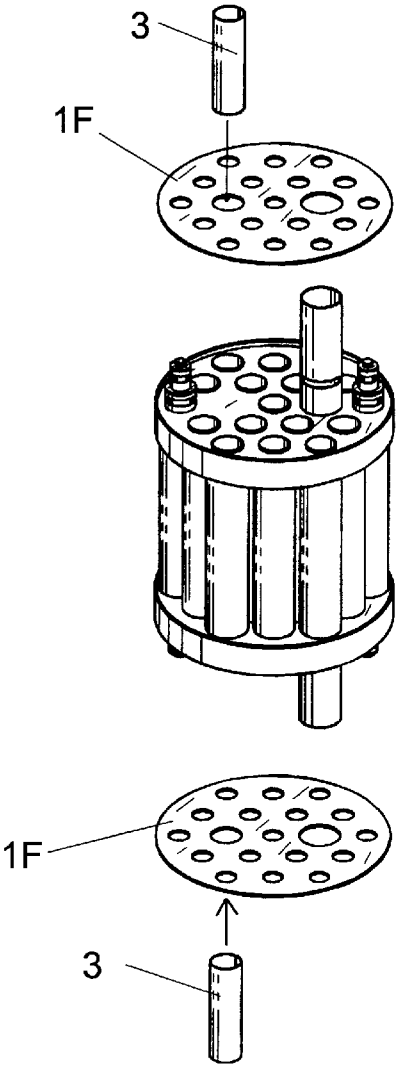
Figure 10P:
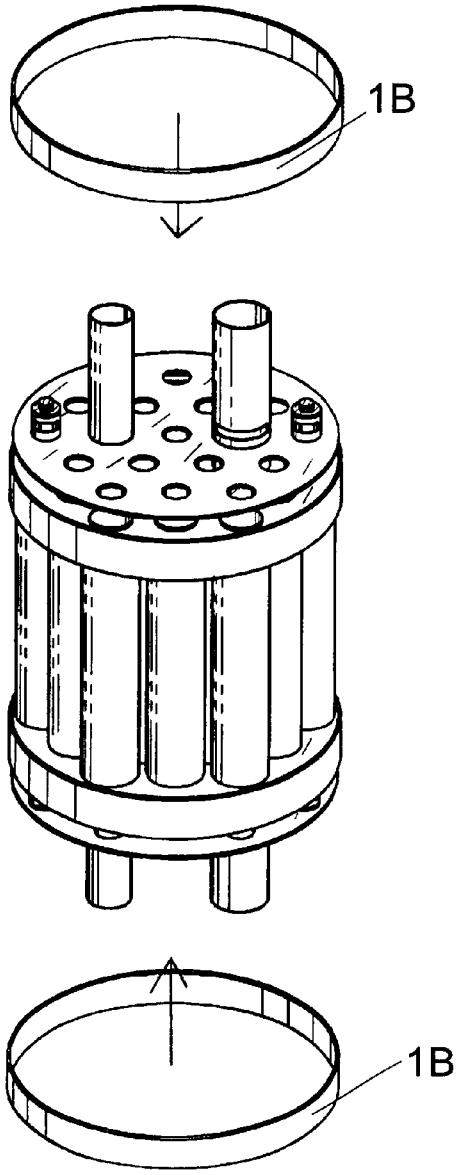
Figure 10Q:
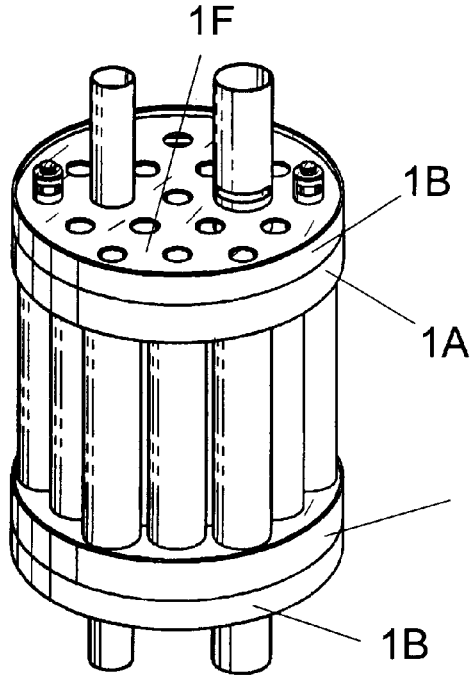
Figure 10R:
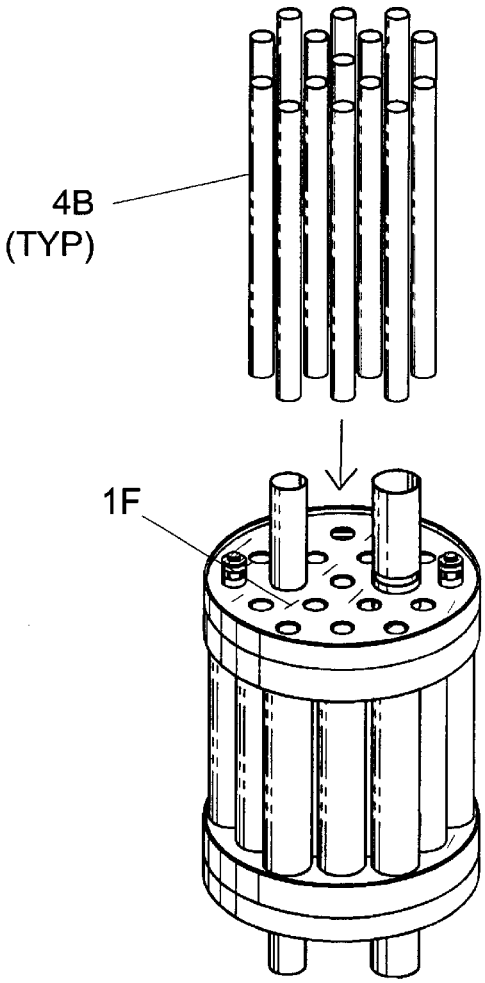

FIG. 10N shows the outer high pressure plate 1F after it has been drilled, bored or punched to fit the inner heat exchange tube (4B and 5B in FIG. 4) diameter and drilled, bored, or punched to fit the low and high pressure flow tubes (2 and 3 in FIG. 7). The two high pressure flow tubes 3 are also cut to length at this point.

Next (FIG. 10P) the two high pressure flow tubes 3 are attached to the outer high pressure plates 1F by welding, brazing or other appropriate means. The resulting subassembly is attached (FIG. 10Q) to the tooling concentric tube assemblies 5 of the subassembly from FIG. 10M. At this point the joint between 1F and 5 is primarily determined by accuracy and rigidity. This joint will eventually need to be pressure and leak resistant but the final joining can wait until the inner heat exchange tubes (4B in FIG. 4) are joined to 1F in a later step.

Figure 10S:
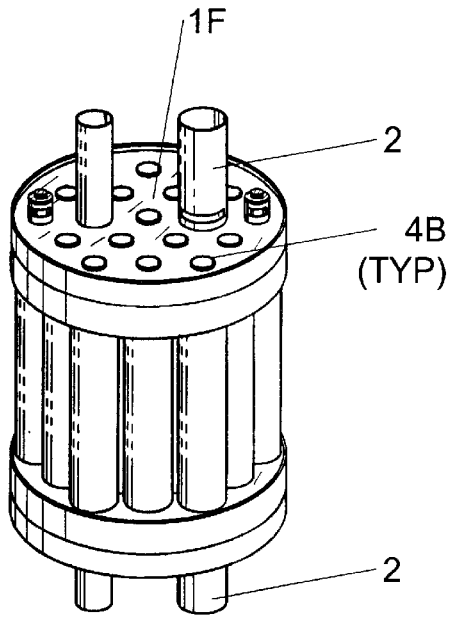
Figure 10T:
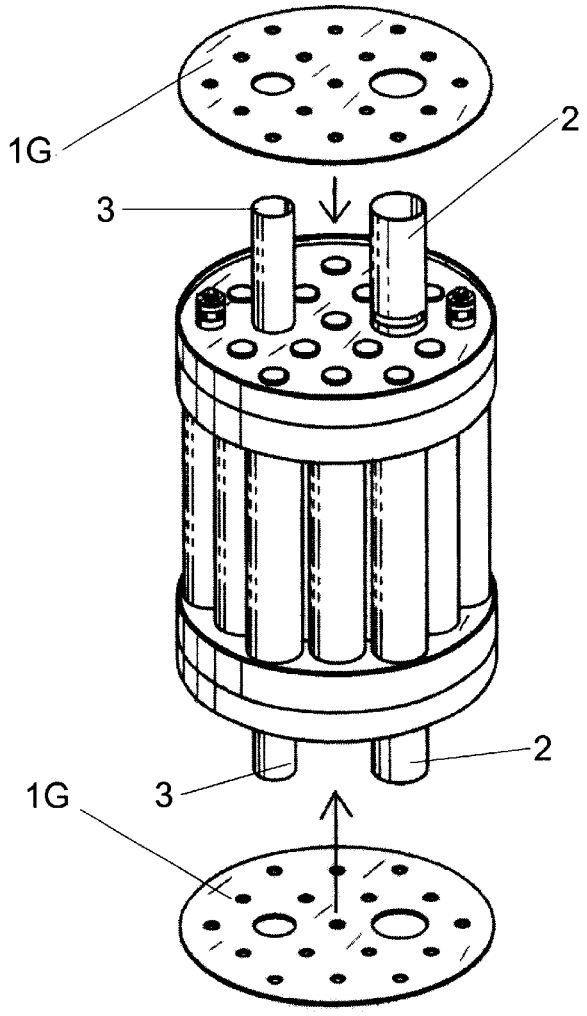

The high pressure rings 1B are next cut to length (FIG. 10R) and joined to the outer high pressure plates 1F and inner low pressure rings 1B by welding, brazing or other appropriate means (FIG. 10S).

Figure 10U:
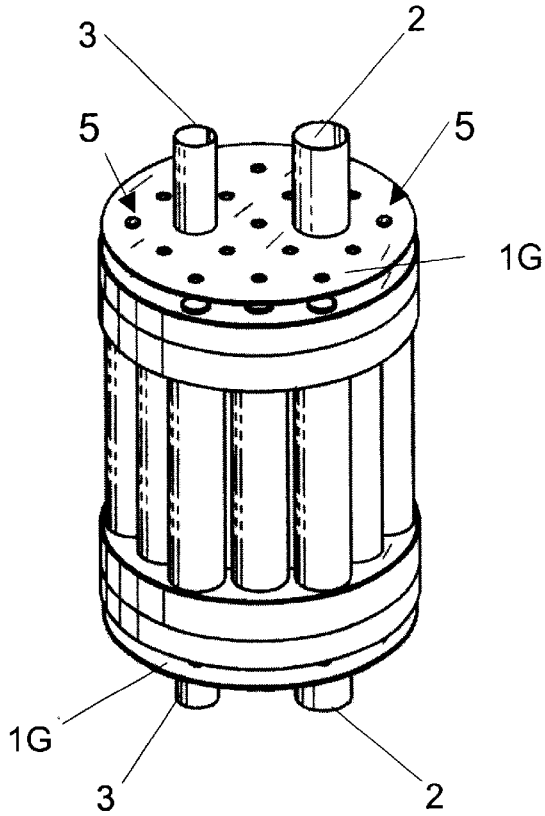

The next step (FIG. 10T) is to cut the basic concentric tube assembly inner heat exchange tubes 4B to length and insert them into the holes in the subassembly from FIG. 10S. In FIG. 10U, the inner heat exchange tubes 4B and the low pressure flow tubes 2 are attached to the outer high pressure plates 1F by welding, brazing or other appropriate means suitable to provide a pressure and leak resistant joint at the operating temperatures and pressures.

Figure 10V:
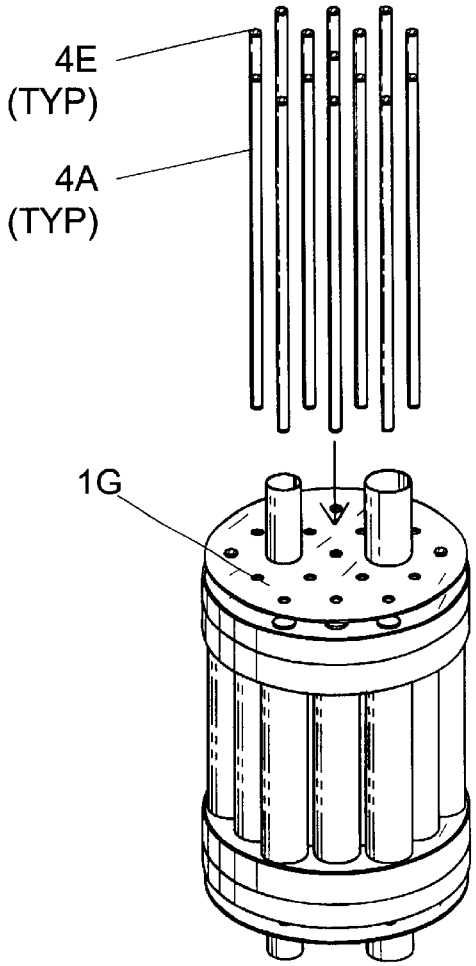

FIG. 10V shows the outer low pressure plates 1G after they have been drilled, bored, or punched to fit the center low pressure tubes (4A and 5A in FIG. 4) diameter and drilled, bored, or punched to fit the low high pressure flow tubes 2 and high pressure flow tubes 3.

The outer low pressure plates 1G are attached (FIG. 10W) to the tooling concentric tube assemblies 5 of the subassembly from FIG. 10U. At this point the joint between 1G and 5 is primarily determined by accuracy and rigidity. This joint will eventually need to be pressure and leak resistant but the final joining can wait until the center low pressure tubes (4A in FIG. 4) are joined to 1G in a later step. Similarly, the outer low pressure plates 1G can be joined to the low high pressure flow tubes 2 and high pressure flow tubes 3 by welding, brazing or other appropriate means at this step or during the joining of the center low pressure tubes.

Figure 10W:
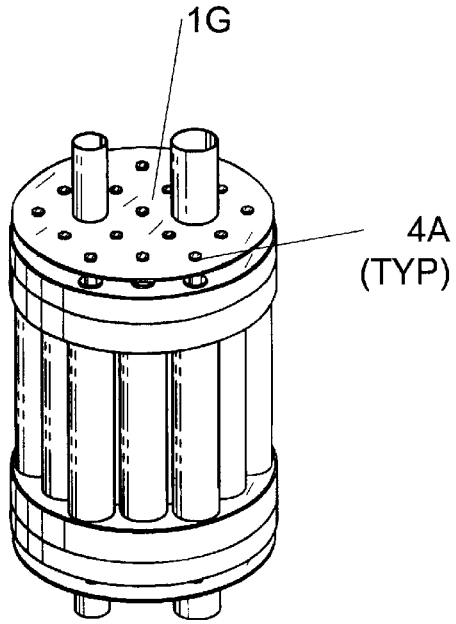
Figure 10X:
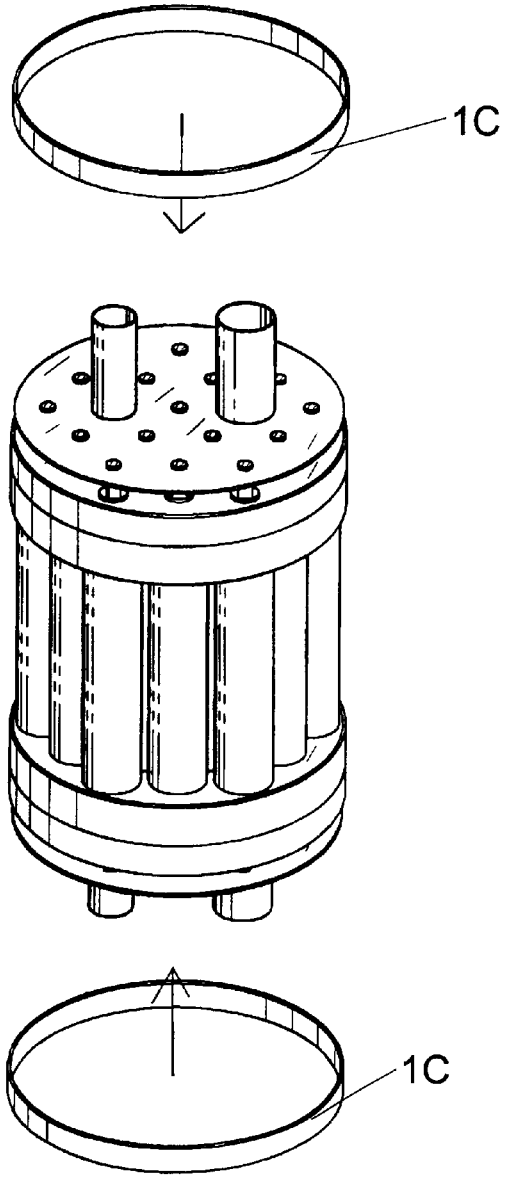
Figure 10Y:
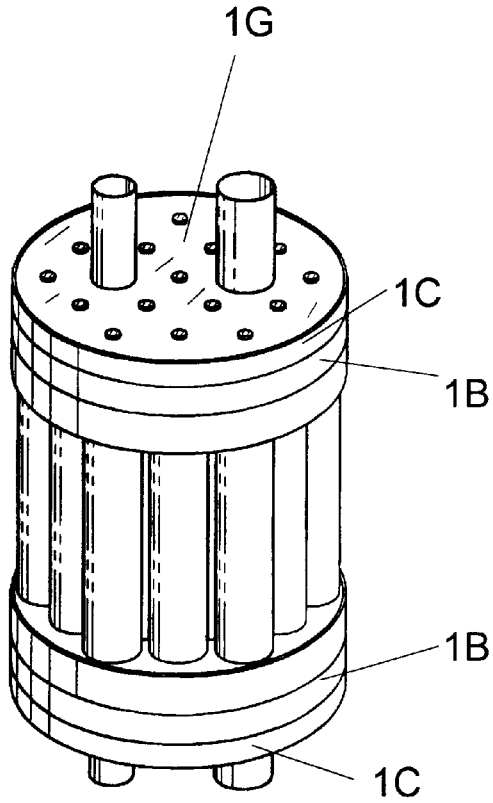
Figure 10Z:
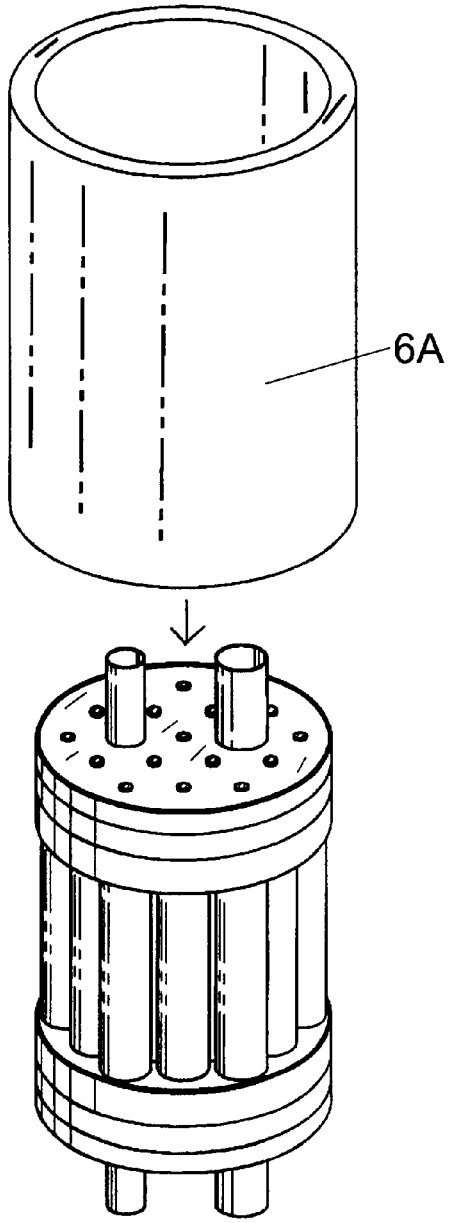
Figure 10A:
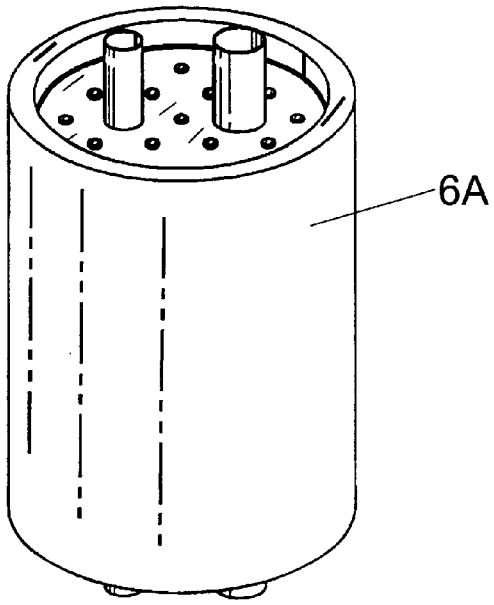
Figure 10A:
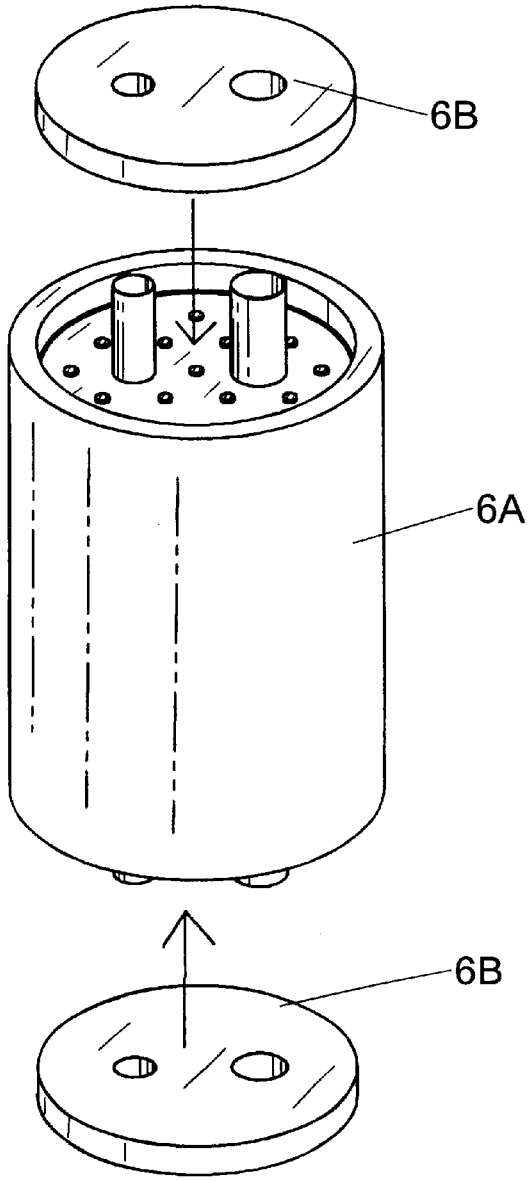
Figure 10A:
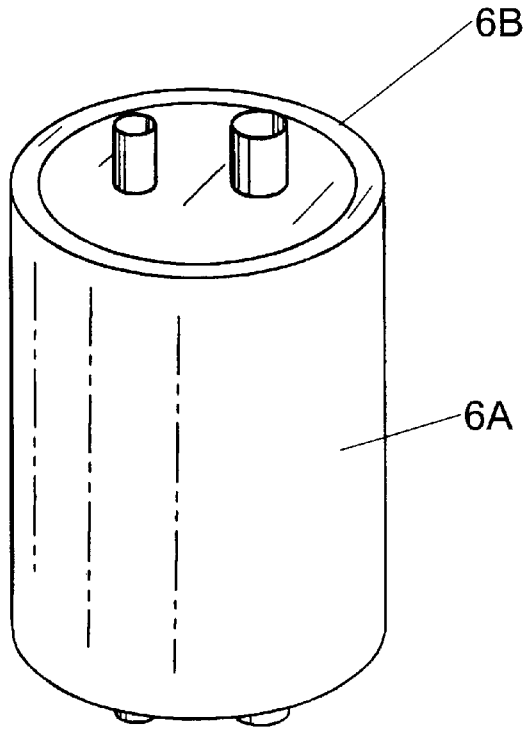
Figure 10A:
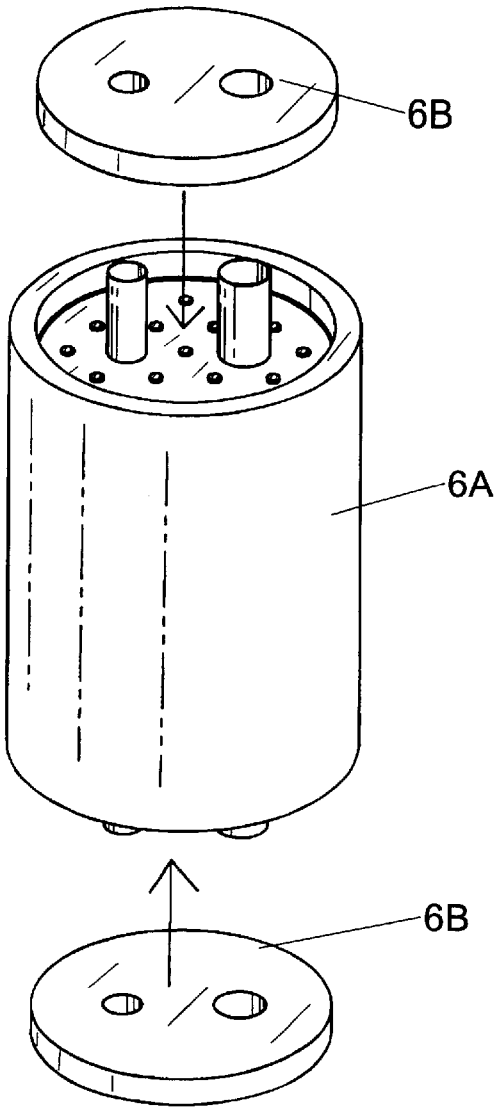
Figure 10A:
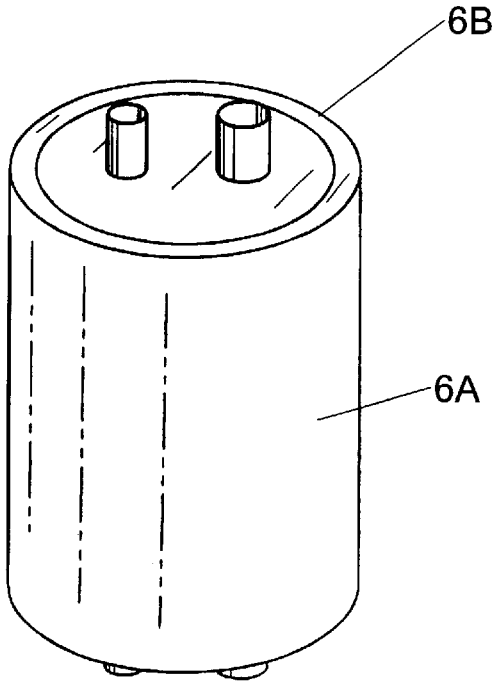

The next step (FIG. 10X) is to cut the basic concentric tube assembly center low pressure tubes 4A to length, insert the center tube plugs 4E into 4A and insert the plugged tubes into the holes in the subassembly from FIG. 10W. In FIG. 10Y, the basic concentric tube assembly center low pressure tubes 4A are attached to the outer low pressure plates 1G by welding, brazing or other appropriate means suitable to provide a pressure and leak resistant joint at the operating temperatures and pressures.

The outer low pressure rings 1C are next cut to length (FIG. 10Z) and joined to the outer low pressure plates 1G and the high pressure rings 1B by welding, brazing or other appropriate means (FIG. 10AA). This completes the metal work on the recuperator.

An insulation cylinder 6A is wrapped around the subassembly of FIG. 10M as shown in FIG. 10AB to form the subassembly of FIG. 10AC. The ends are then insulated (FIG. 10AD) with insulation end caps 6B to complete the manufacturing process (FIG. 10AE).

Heat Transfer and Flow Characteristics of the Annular Flow Concentric Tube Recuperator

Basic Characteristics

Figure 11:
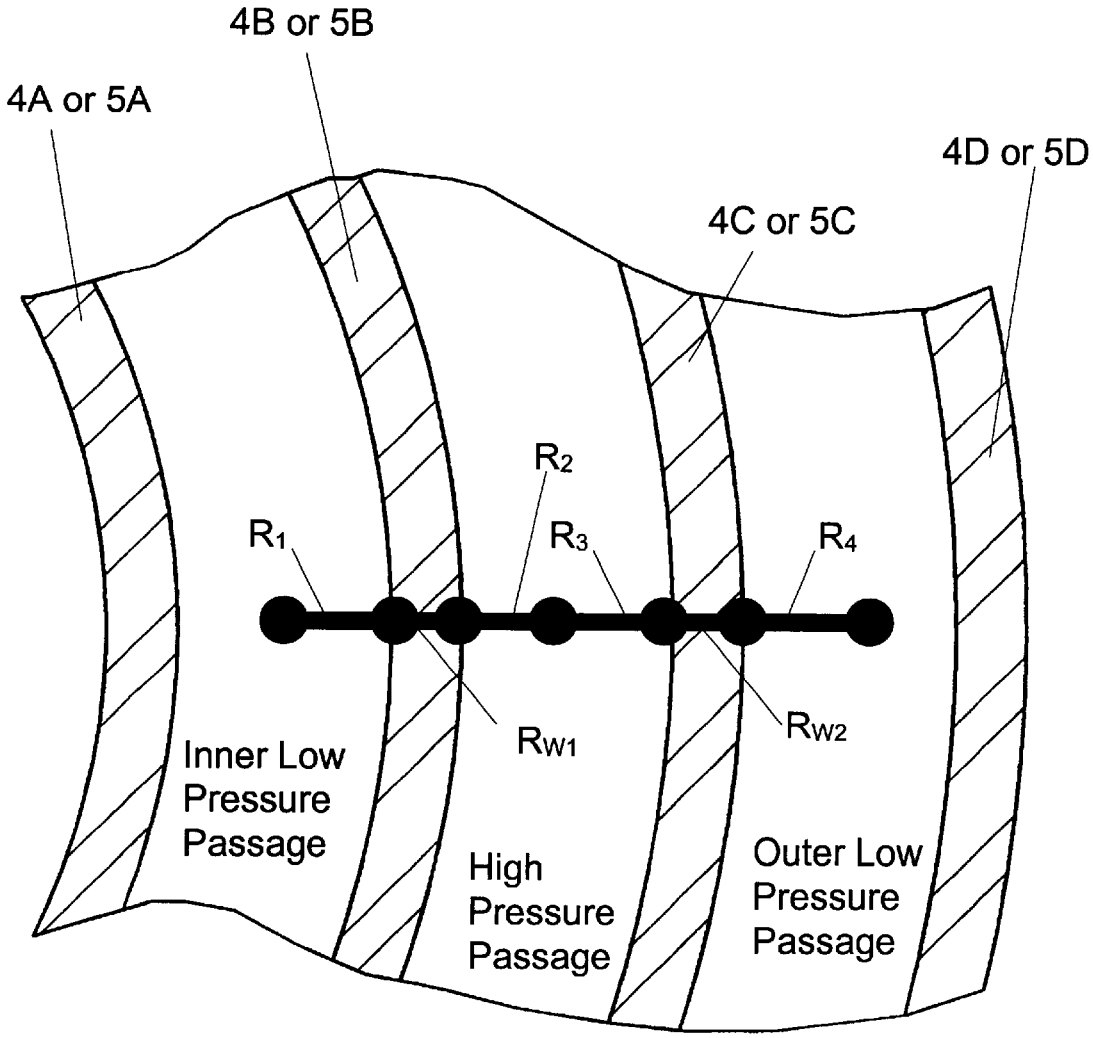
FIG. 11 shows the heat transfer process through the annular walls.
Figure 12:
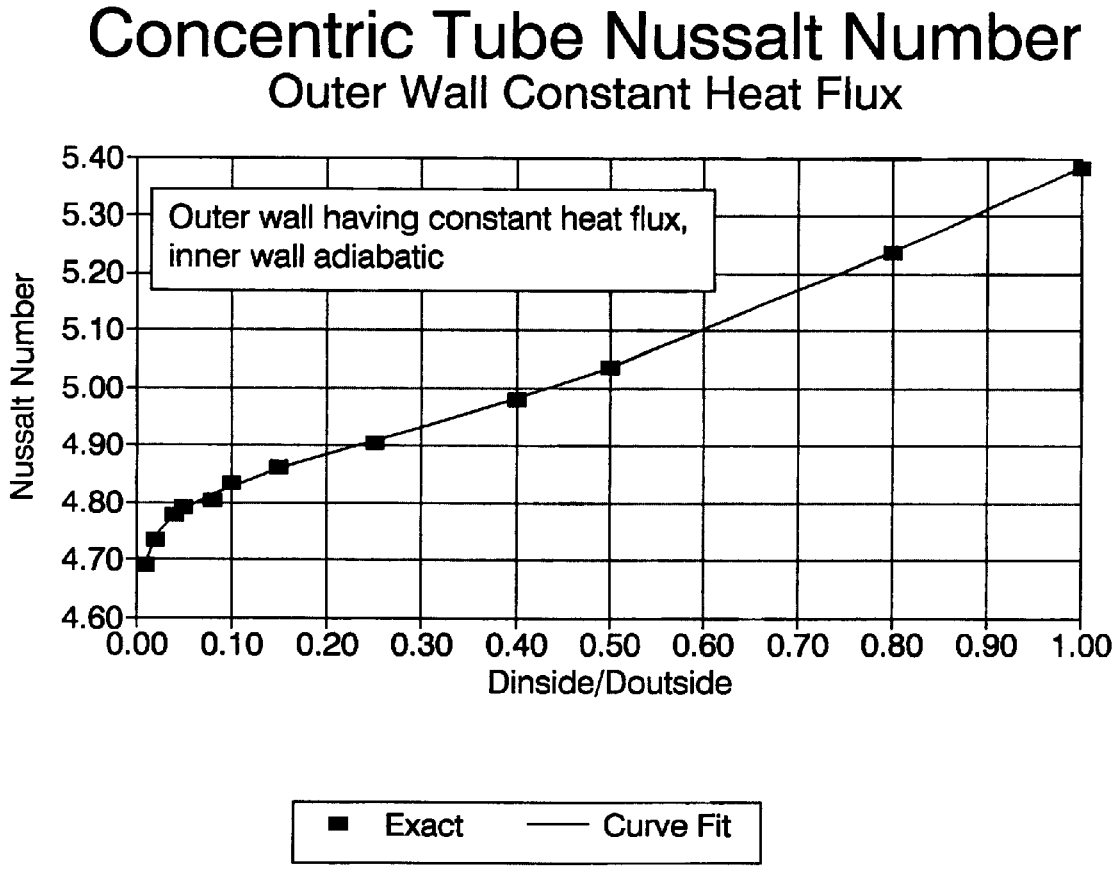
FIG. 12 shows the laminar flow Nussalt Number for the inner low pressure passage of FIG. 11.
Figure 13:
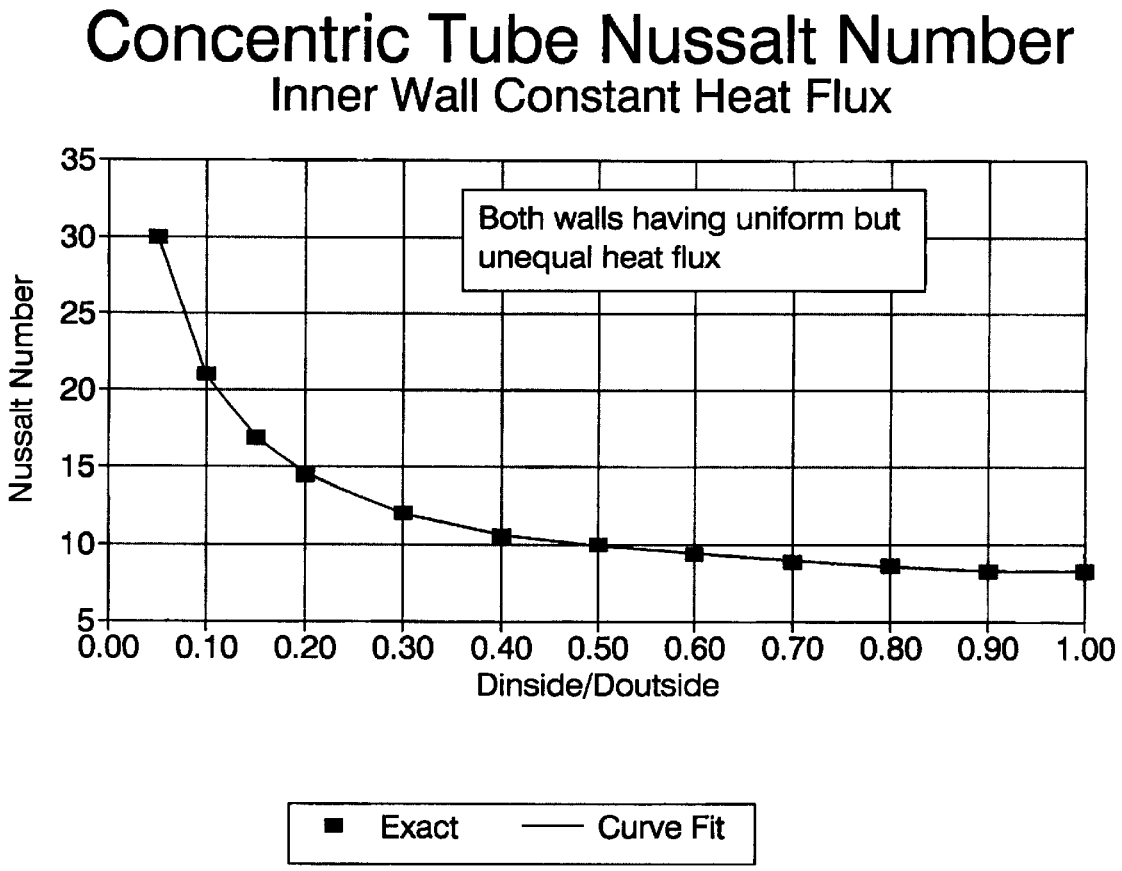
FIG. 13 shows the laminar flow Nussalt Number for the inner wall of the high pressure passage of FIG. 11.
Figure 14:
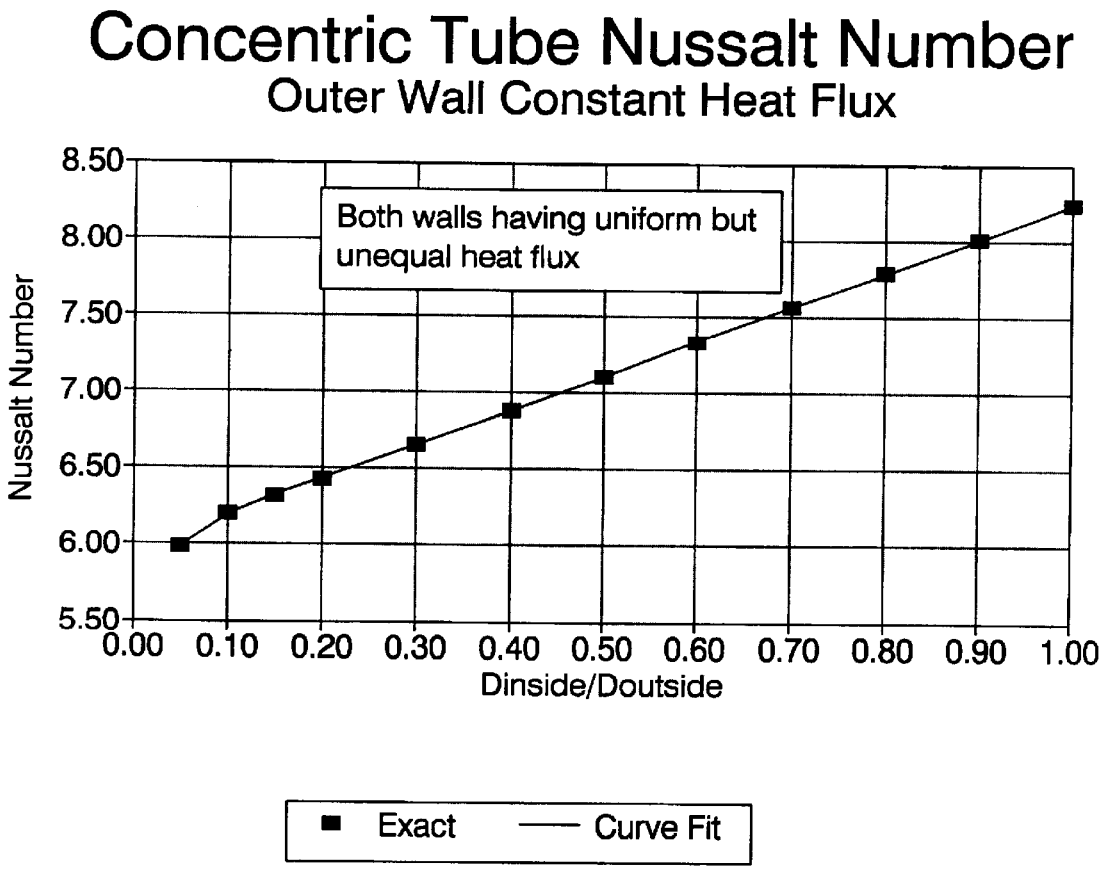
FIG. 14 shows the laminar flow Nussalt Number for the outer wall of the high pressure passage of FIG. 11.
Figure 15:
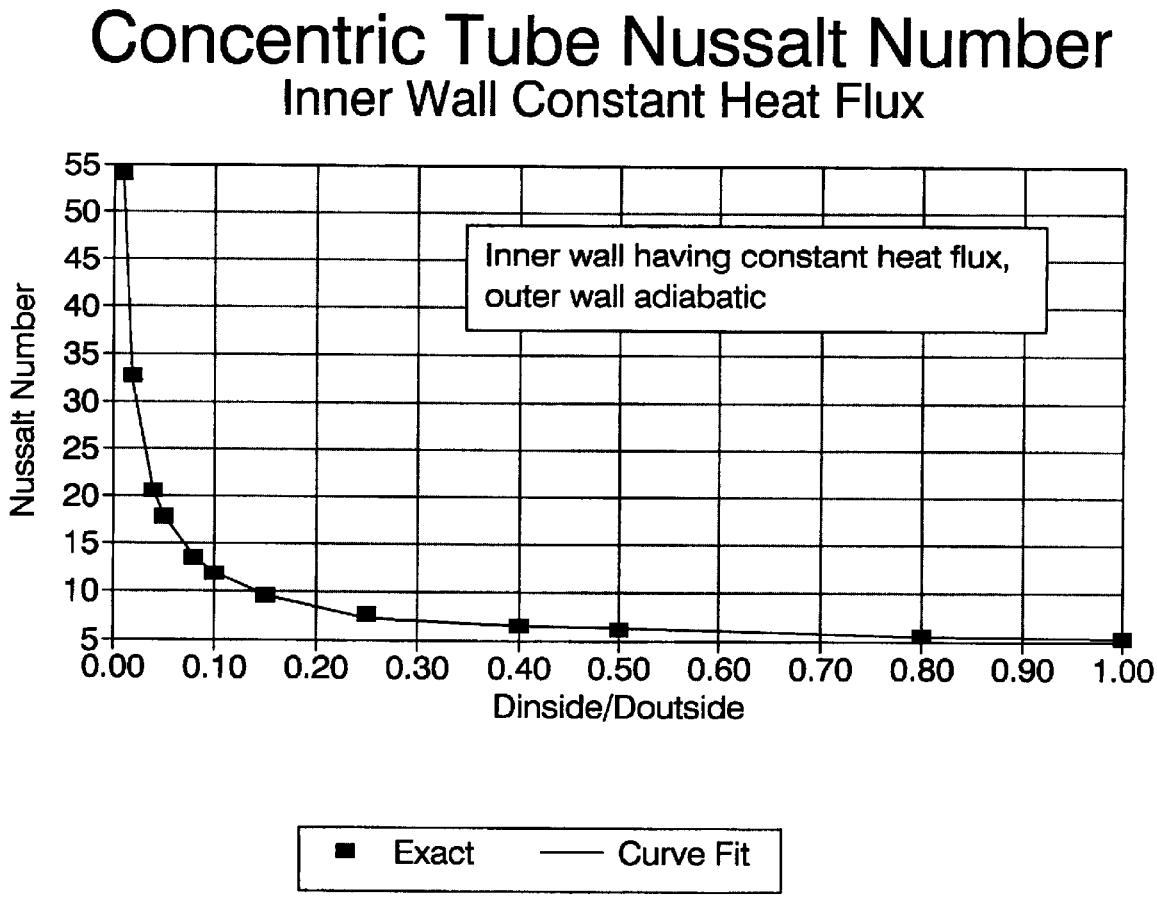
FIG. 15 shows the laminar flow Nussalt Number for the outer low pressure passage of FIG. 11.

The key parameter in recuperator performance is the effectiveness. The effectiveness describes the ratio of heat added to the high pressure compressor exit air to the maximum possible heat that could be added:

$$e=(T_{air\text{-}out}-T_{air\text{-}in})/(T_{ex\text{-}in}-T_{air\text{-}in}) \quad (1)$$

where $T_{air\text{-}in}$=temperature of air entering the recuperator $T_{air\text{-}out}$=temperature of air leaving the recuperator $T_{ex\text{-}in}$=temperature of exhaust gas entering the recuperator The basic heat transfer element of the recuperator is a concentric tube assembly that, in the preferred embodiment, is comprised of four concentric tubes that enclose three concentric annular flow passages. Heat is transferred from the exhaust gas to the compressor air though the tube walls on each side of the high pressure passage. Two low pressure passages are provided for each high pressure air passage to compensate for the lower pressure (and therefore lower density) of the exhaust gas. The equivalent thermal resistance network for the heat transfer through the concentric tube walls is shown in FIG. 11 and, neglecting radiation heat transfer between the tube walls, conservatively consists of:

a) a convection resistance, $R_1$, between the inner low pressure exhaust gas and the inner heat exchange tube 4B or 5B:

$$R_1=1/(h_1A_1) \tag{2}$$

where:

$h_1$=heat transfer coefficient $A_1$=area of inside of tube 4B or 5B b) a conduction resistance, $R_{w1}$, through the wall of the inner heat exchange tube 4B or 5B:

$$R_{w1}=\{\ln[D_{w1}/(D_{w1}-2t_{w1})]\}/(2\pi k_w L_1) \tag{3}$$

where:

$D_{w1}$=outside diameter of inner heat exchange tube $t_{w1}$=wall thickness of inner heat exchange tube $k_w$=thermal conductivity of wall $L_1$=length of inner heat exchange tube ln=natural logarithm c) a convection resistance, $R_2$, between the inner heat exchange tube 4B or 5B and the high pressure air:

$$R_2=1/(h_2A_2) \tag{4}$$

where:

$h_2$=heat transfer coefficient $A_2$=area of outside of tube 4B or 5B d) a convection resistance, $R_3$, between the high pressure air and the outer heat exchange tube 4C or 5C:

$$R_3=1/(h_3A_3) \tag{5}$$

where:

$h_3$=heat transfer coefficient $A_3$=area of inside of tube 4C or 5C e) a conduction resistance, $Rw_2$, through the wall of the outer heat exchange tube 4C or 5C:

$$R_{w2}=\{\ln[D_{w2}/(D_{w2}-2t_{w2})]\}/(2\pi k_w L_2) \tag{6}$$

where:

$D_{w2}$=outside diameter of outer heat exchange tube $t_{w2}$=wall thickness of inner heat exchange tube $k_w$=thermal conductivity of wall $L_2$=length of inner heat exchange tube f) a convection resistance, $R_4$, between the outer heat exchange tube 4B or 5B and the outer low pressure exhaust gas:

$$R_4=1/(h_4A4) \tag{7}$$

where:

$h_4$=heat transfer coefficient $A_4$=area of outside of tube 4C or 5C

The heat transfer coefficients $h_1$, $h_2$, $h_3$, and $h_4$are found from the general relation:

$$h=(Nu\ k)/(D_{outside}-D_{inside}) \tag{8}$$

where h=heat transfer coefficient

Nu=Nussalt Number k=thermal conductivity of air or exhaust $D_{outside}$=outside diameter of respective annular space $D_{inside}$=inside diameter of respective annular space In the preferred embodiment, flow in the annular spaces is in the laminar flow regime where the Reynolds Number (based on hydraulic diameter) is less than 2000. The Nussalt numbers for laminar flow in concentric annular ducts are found from the following relations developed from data in [Rohsenow, Warren M., et al: *Handbook of Heat Transfer*, McGraw-Hill (1998) p. 5.34 and p.5.37.]

$$Nu_1=4.767736+0.797457r^*-0.00084/r^*-1.32564(r^*)^2+2.074918(r^*)^3-0.92823(r^*)^4 \tag{9}$$

$$Nu_2=18.1829-56.5341r^*+0.71851/r^*+126.5151(r^*)^2-129.592(r^*)^3+48.9783(r^*)^4 \tag{10}$$

$$Nu_3=6.22237+0.871312r^*-0.01462/r^*+3.29872(r^*)^2-3.44747(r^*)^3+1.306091(r^*)^4 \tag{11}$$

$$Nu_4=11.3201-47.6045r^*+0.433618/r^*+136.2328(r^*)^2-161.939(r^*)^3+66.94174(r^*)\ (r^*)^4 \tag{12}$$

where $r^*=D_{inside}/D_{outside}$ and the subscripts for each Nu correspond to the convection resistance subscripts of equations (2), (4), (5), and (7) and FIG. 11. Equations (9) through (12) are shown graphically in FIG. 12 through FIG. 15 respectively. It should be noted that the laminar flow Nussalt number and consequently the laminar flow heat transfer coefficients are purely functions of the air or gas thermal properties and the geometry of the concentric flow passages. They are independent of the flowrates or velocities. Since the thermal conductivity of the air or exhaust varies considerably in a typical recuperator, the thermal conductivity to be used in equation (8) should be evaluated by:

$$k=[k(t_{inlet})+4k(t_{avg})+k(t_{outlet})]/6 \tag{13}$$

where $k(t_{inlet})$=thermal conductivity at inlet temperature $k(t_{avg})$=thermal conductivity at average of inlet and outlet temperatures $k(t_{outlet})$=thermal conductivity at outlet temperature.

After the individual resistances have been determined, the overall heat transfer conductance, UA, is determined from:

$$UA=1/(R_1+R_{w1}+R_2)+1/(R_3+R_{w2}+R_4) \tag{14}$$

The number of transfer units, NTU, is then found from:

$$NTU_{air}=UA/(W_{dot}C_p)_{air} \tag{15}$$

and $$NTU_{ex}=UA/(W_{dot}C_p)_{ex} \tag{16}$$

where $W_{dot}$=mass flowrate

Cp=average specific heat determined by the same averaging method by which thermal conductivity was determined in equation (13)

Subscripts$_{air}$ and $_{ex}$ refer to the high pressure air and low pressure exhaust respectively The ideal effectiveness, $e_{ideal}$, of the recuperator is found from:

$$e_{ideal}=\Psi_{air}/(1+\Psi_{ex}) \tag{17}$$

where $$\Psi_{air}=[\exp^{(NTu\text{ex}-\text{NTuair})}-1]/(NTU_{ex}/NTU_{air}-1)$$

$$\Psi_{ex}=[\exp^{(NTu\text{ex}-NTu\text{air})}-1]/(1-NTU_{air}/NTU_{ex})$$

exp=base of natural logarithms

The other key parameter in recuperator performance is pressure drop. The pressure drop through the annular flow passage is given by the following expression that accounts for friction, inlet and entrance losses, and momentum gain or loss due to heating or cooling respectively:

$$\Delta P=[4F(L/D_h)+K]\rho V^2/(2G_c)+W_{dot}(V_{outlet}-V_{inlet})/(G_cA) \quad (18)$$

where $\Delta P$=pressure drop

F=friction factor

L=Length of annular passage $D_h$=hydraulic diameter=$D_{outside}-D_{inside}$

K=head loss factor due to entrance and exit=1.78

$\rho$=mean density of air or exhaust calculated by the method of equation (13)

$$V=average\ velocity=(4W_{dot})/\{\rho\pi[(D_{outside})^2-(D_{inside})^2]\}$$

$$V_{outlet}=\text{outlet velocity}=(4W_{dot})/\{\rho_{outlet}\pi[(D_{outside})^2-(D_{inside})^2]\}$$

$$V_{inlet}=\text{inlet velocity}=(4W_{dot})/\{\rho_{inlet}\pi[(D_{outside})^2-(D_{inside})^2]\}$$

$G_c$=acceleration of gravity

A=area of annulus=$\pi[(D_{outside})^2-(D_{inside})^2]$

The friction factor for laminar flow in an annular concentric passage, including entrance effects, is given by [Rohsenow, Warren M., et al: *Handbook of Heat Transfer, McGraw-Hill (*1998) p. 5.36.]:

$$F\,Re=3.44/L^{*1/2}+[0.674/(4L^*)+24-3.44/L^{*1/2}]/(1+0.000029/L^{*2}) \quad (19)$$

where

Re=Reynolds number of flow based on hydraulic diameter, $D_h$ $L^*=L/(D_hRe)$

In addition to the pressure drop through the concentric tube assemblies, there is also a pressure drop through the header sections. When the flow enters the inlet header, it expands radially from the flow tube (2 or 3 in FIG. 5). Referring again to FIG. 5 and FIG. 6, it can be seen that the concentric tube assemblies (4 and 5) form tube bundles that the header flow must pass though as it works its way to each of the concentric tube assemblies. The velocity profile through the header is determined by the radial expansion of the flow and the essentially uniform loss of flow to each concentric tube assembly as the flow expands through the header. At the corresponding outlet header, the flow process reverses as the flow returns to the flow tube from each of the concentric tube assemblies. The velocity field, $V_h(R)$, in each of the headers as a function of the distance from the flow tube center is then determined by:

$$V_h(R)=W_{dot}\{[(R_o+\delta)^2/R]-R\}/[2\rho H\pi(R_o^2-R_s^2)] \quad (20)$$

where:

$R_o+\delta$=radial distance from flow tube center to farthest concentric tube assembly center $R_o$=radius of header plate $\delta$=amount flow tube is offset from center of recuperator R=radial distance from flow tube center H=height of header (distance between header plates)

$R_s$=radial distance from flow tube center to first concentric tube assembly center The effective friction factor for the flow through the tube bundles is found from a curve fit to [Rohsenow, Warren M., et al: *Handbook of Heat Transfer*, McGraw-Hill (1998) p. 17.116.]:

$$F_h=250/(x^{5.663}Re_h)+0.063+0.075[1+0.47/(x-1)^{1.08}]/(Re_h0.16) \quad (21)$$

where:

x=ratio of distance between tubes to tube diameter $Re_h$=Reynolds number based on tube diameter and the velocity between the tubes:

$$V_{hmax}(R)=[V_h(R)\times]/(x-1) \quad (22)$$

The average frictional headloss factor, $FV_{hmax}^2$, is given by:

$$FV_{hmax}^2=(FV_{hmax}^2|_{Rs}+4FV_{hmax}^2|_{(Rs+Ro+\delta)/2})/6 \quad (23)$$

Where each term on the right side is made up of the product of friction factor (21) and the square of velocity between the tubes (22) evaluated at the first concentric tube assembly, $R_s$, and the mean radius $(R_s+R_o+\delta)/2$ respectively.

The total header pressure drop can then be evaluated from:

$$\Delta P_h=4N[(\rho FV_{hmax}^2)_{inlet}+(\rho FV_{hmax}^2)_{outlet}]/(2G_c)+[(\rho V_s^2)_{outlet}-(\rho V_s^2)_{inlet}/(2G_c) \quad (24)$$

Where

N=number of tube banks $(R_o+\delta-R_s)/D_{pitch}$ $D_{pitch}$=distance between tubes $V_s$=Velocity from (20) with $R=R_s$ Subscript$_{outlet}$ indicates evaluated at outlet conditions Subscript$_{inlet}$ indicates evaluated at inlet conditions The combined pressure drop, $\Delta P_{total}$, through the concentric tube assemblies and headers, accounting for the flow maldistribution induced by the header pressure drop is then:

$$\Delta P_{total}=\Delta P(1+\Delta P_h/\Delta P)/[1+\Delta P_h/(2\Delta P)] \quad (25)$$

The high pressure side pressure drop can be calculated directly from (25). However, since the flow is split into two paths on the low pressure side, the flow split is calculated by a numerical solution of (25) for the proportion of the total mass flow in each passage that results in equal pressure drops in same in both channels.

Corrections for Non-Ideal Characteristics

The ideal recuperator effectiveness of (17) can be approached by good workmanship but cannot be fully achieved because of longitudinal heat conduction in the concentric tube assemblies, longitudinal convection within the recuperator, eccentricity of the tube assemblies, maldistribution due to header pressure drop, maldistribution due to tube diameter tolerances, tube fouling on the exhaust side, and ambient heat losses.

Figure 16:
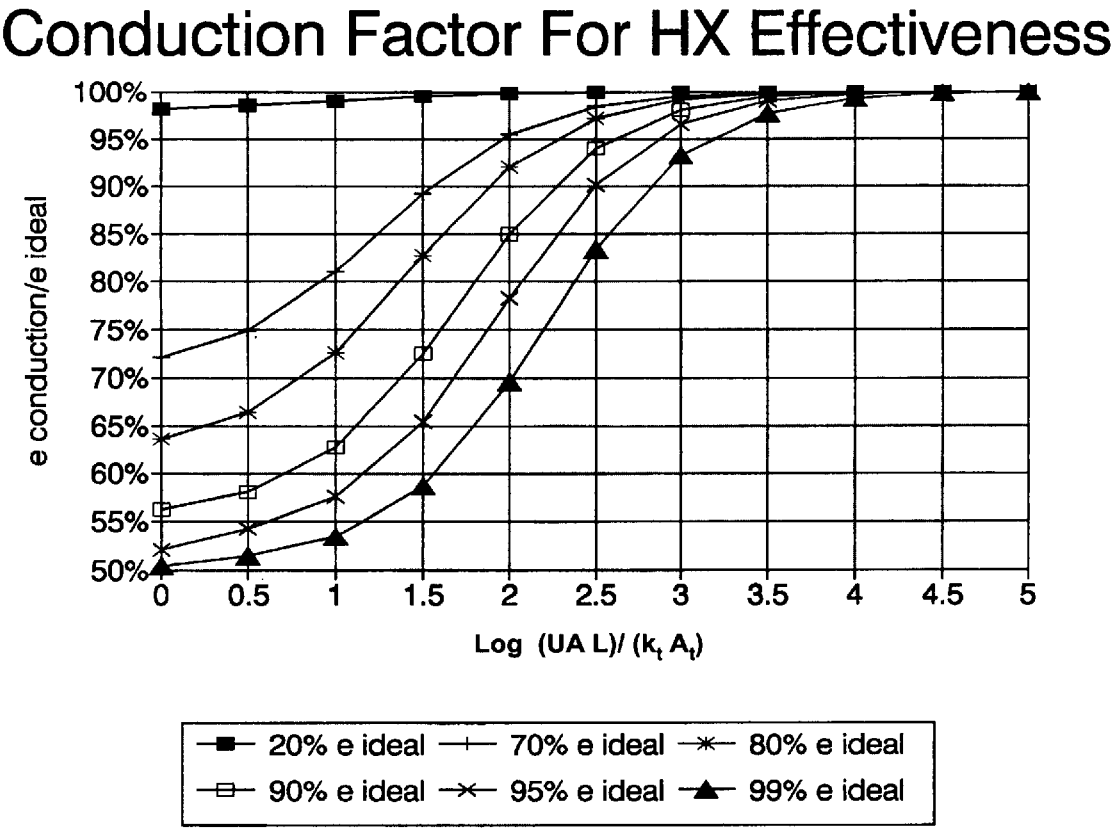
FIG. 16 shows the factor for the effectiveness loss due to axial conduction through the recuperator tubes.

Longitudinal conduction of heat through the tube walls is a form of thermal short circuiting. It becomes increasingly important for recuperators designed for increasingly high effectiveness. FIG. 16 shows the effect of longitudinal conduction from finite element calculations. The figure shows the percentage of the ideal effectiveness that remains after accounting for longitudinal conduction as a function of $(UA\,L)/(k_tA_t)$ where UA is the overall heat transfer conductance from (14), L is the length of the shortest tube (4D in FIG. 1), $k_t$ is the effective average thermal conductivity of the tube wall material, and $A_t$ is the total cross sectional area of all the tubes. The results are shown for 6 cases of ideal effectiveness ranging from 20% to 99%.

Longitudinal convection of heat can also cause a loss of effectiveness. Longitudinal convection occurs if the recuperator has the cold end higher than the hot end and is caused by free convection carrying heat back from the hot end to the cold end in the air spaces between the concentric tube assemblies. It can be avoided by always mounting the recuperator horizontally or with the hot end up.

Figure 17:
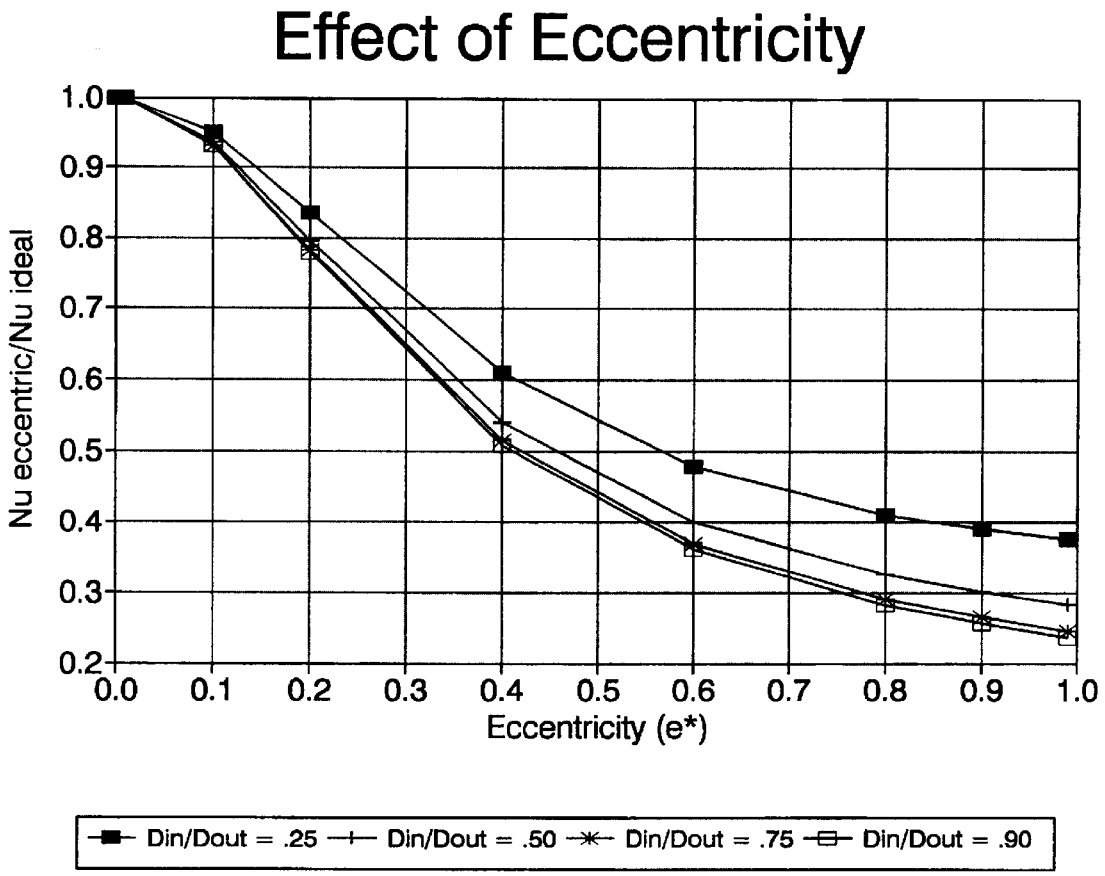
FIG. 17 shows the factor for reduction in laminar flow Nussalt Number due to the tubes not being perfectly concentric.

The tubes in the concentric tube assemblies cannot be perfectly concentric because of tolerances in making the holes in the header plates, tolerance between the tube outer diameter and the header plate holes, the tubes not being manufactured perfectly straight, tube sagging, and misalignment of the header plates. FIG. 17 shows the net effect of these factors as the ratio of actual to ideal Nussalt number as a function of tube eccentricity, e*, and ratio of inside to outside annular tube diameter [Rohsenow, Warren M., et al: *Handbook of Heat Transfer*, McGraw-Hill (1998) p.5.49.]. The eccentricity is defined as:

$$e=2\epsilon/(D_{outside}-D_{inside}) \tag{26}$$

where $\epsilon$=the distance between the two circular walls.

Laminar flow provides a resistance to flow maldistribution losses because the overall heat transfer conductance is independent of the flowrate. Therefore, to first order, the overall average number of transfer units from (15) and (16) is independent of flow distribution. However, if the flow is not exactly distributed, some concentric tube assemblies will have an excessive amount of high pressure air flow in relation to the low pressure exhaust flow. In those tubes, there is not enough energy available from the exhaust to completely warm the air. This effect is mitigated where the air to exhaust flow ratio is higher than average but is not completely eliminated.

Figure 18:
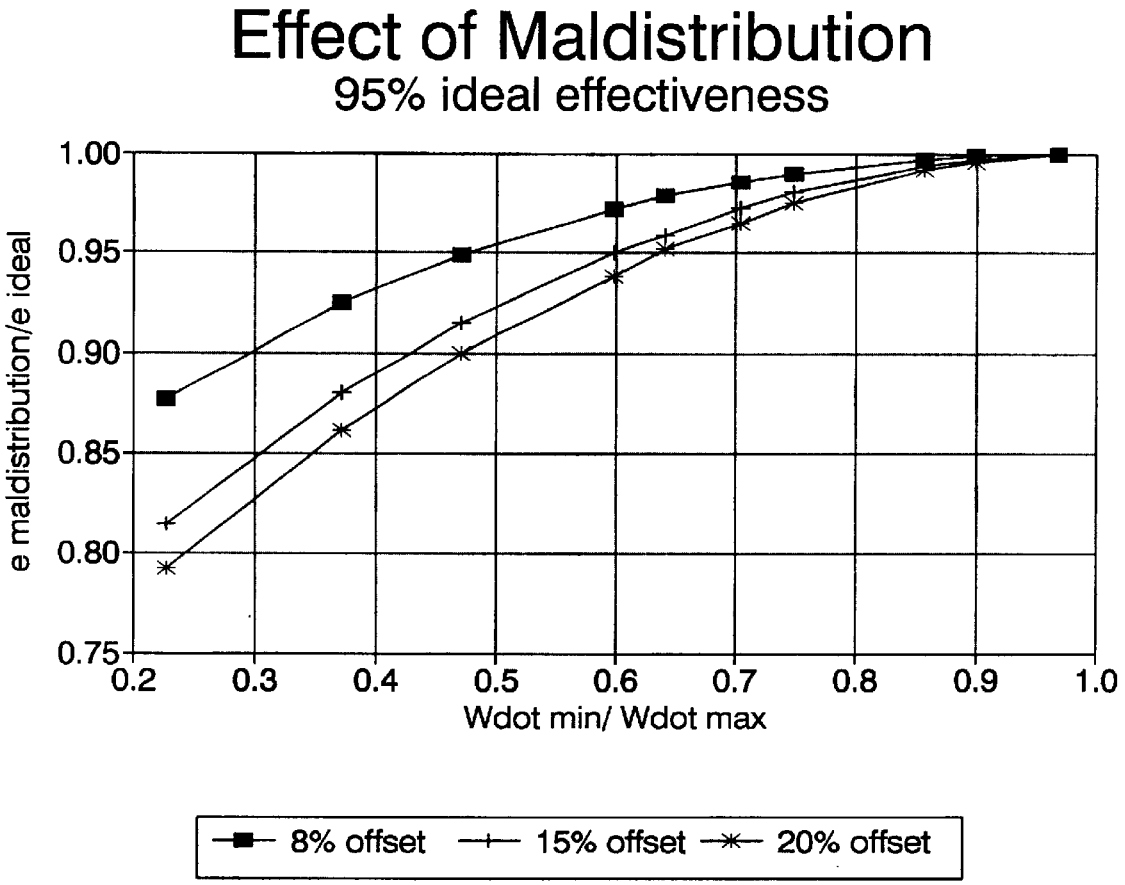
FIG. 18 shows the effectiveness lost by flow misdistribution caused by pressure drop in the headers.

FIG. 18 shows the effect of maldistribution due to header pressure drop on a 95% ideal effectiveness recuperator. The vertical axis is the ratio of actual to ideal effectiveness and the horizontal axis is the ratio of the minimum to maximum flow, $W_{dot\ min}/W_{dot\ max}$, through the concentric tube assemblies. The three offset cases refer to three ratios of the amount the centers of the flow tubes (2 and 3 in FIG. 7) are offset from the center of the recuperator divided by the radius of the header plates (such as 1D in FIG. 7). As the flow tubes are moved further from the center, the amount of imbalance between the high and low pressure flows increases and the actual effectiveness consequently decreases. The minimum to maximum flow ratio is found by:

$$W_{dot\ min}/W_{dot\ max}=1/(1+\Delta P_h/\Delta P). \tag{27}$$

From (27) and FIG. 18, it can be seen that if the ratio of header pressure drop, $\Delta P_h$, to tube pressure drop, $\Delta P$, is maintained at less than 20%, effectiveness loss due to header flow maldistribution can be reduced to very small levels.

Figure 19:
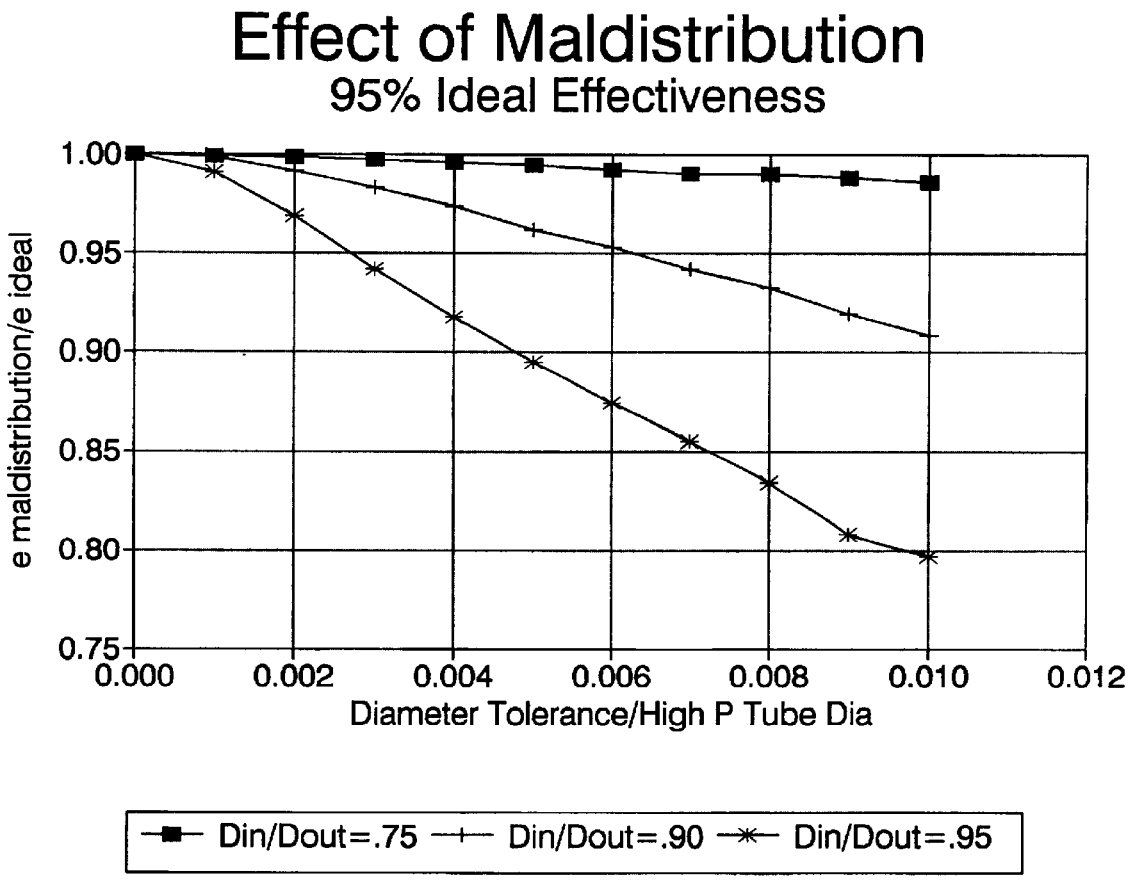
FIG. 19 shows the effectiveness lost by flow misdistribution caused by manufacturing variations in tube size.

The tubes that make up the concentric tube assemblies have manufacturing tolerances on the diameters that cause a variation in flow through the individual tubes and cause a maldistribution effectiveness loss. The amount of this loss is quantified in the results of Monte-Carlo simulations shown in FIG. 19. In this figure, the actual to ideal effectiveness ratio is plotted as a function of the ratio of tube diameter tolerance to the diameter of the outer high pressure tube (4C in FIG. 2). The results are shown for three different annulus diameter ratios, $D_{inside}/D_{outside}$. FIG. 19 will be somewhat pessimistic if used with published tube tolerances. Although a manufacturer might quote a 0.003" to 0.005" tolerance on 1.00" diameter tubing, if the tubing is bought from the same lot, the tube to tube variation should be much less. It is much more important that the tube sizes be uniform rather than exactly the nominal value.

Tube fouling can reduce effectiveness and increase pressure drop. The annular flow concentric tube recuperator is very resistant to this type of loss. In the preferred embodiment, all flow passages are straight, smooth tubes having no fins, waves or pinch points that could collect soot or other exhaust products.

The final cause of effectiveness loss is heat loss to ambient. This loss is minimized by insulating the recuperator as shown in FIG. 7 (6A and 6B) and is evaluated by:

$$\epsilon_{ins}=\epsilon_{ideal}-C_{ins}[(T_{ex\text{-}in}+T_{air\text{-}in})/2-T_{amb}]/[2(W_{dot}C_p)_{air}(T_{ex\text{-}in}-T_{air\text{-}in})] \tag{28}$$

where:

$\epsilon_{ins}$=effectiveness of insulated recuperator $C_{ins}$=thermal conductance of insulation and any mechanical supports that penetrate the insulation $T_{amb}$=temperature of ambient air Parametric Evaluation of a Typical Recuperator The numerical methods for establishing recuperator effectiveness and pressure drop allow the recuperator to be tailored to best meet the requirements of the application. Size parameters can be varied to meet effectiveness and pressure drop requirements within the constraints imposed by packaging boundaries and manufacturing costs. In the following section, reference is made to a stationary 30 kW generator operating on the Afterburning Ericsson Cycle of my U.S. Pat. No. 5,894,729 (1999). The 30 kW generator is for example only and is not to be considered as limiting the recuperator.

The 30 kW generator recuperator has a high pressure air flowrate of 1075 pounds/hour and enters the recuperator at 90 psia and 291° f. The low pressure exhaust flowrate is 1090 pounds/hour and it enters at 1635° f. The low pressure stream leaves the recuperator at atmospheric pressure, 14.7 psia. The baseline recuperator has 257 concentric tube assemblies comprised of ⅝", ¾", ⅞", and 1" outside diameter tubes. The tube wall thickness is 0.020" for all the tubes except the ⅞"tube which has a 0.028" wall. These tube sizes were selected as being commercially available stainless steel tubes. The maximum pressure stress is only 1400 psi and the tubes can easily withstand that stress at the high exhaust temperature. The tubes are concentric within 0.005" and have a diameter tolerance of 0.002". The baseline heat exchange length (the length of the 1" outer low pressure tube shown as 4D and 5D in FIG. 2) is 50". The diameter of the header plates is 29". The recuperator is insulated with 3 inches of REFRASIL insulation. Overall weight is about 1000 pounds. The recuperator has an effectiveness, after accounting for all loses of 95.3%.

Figure 20:
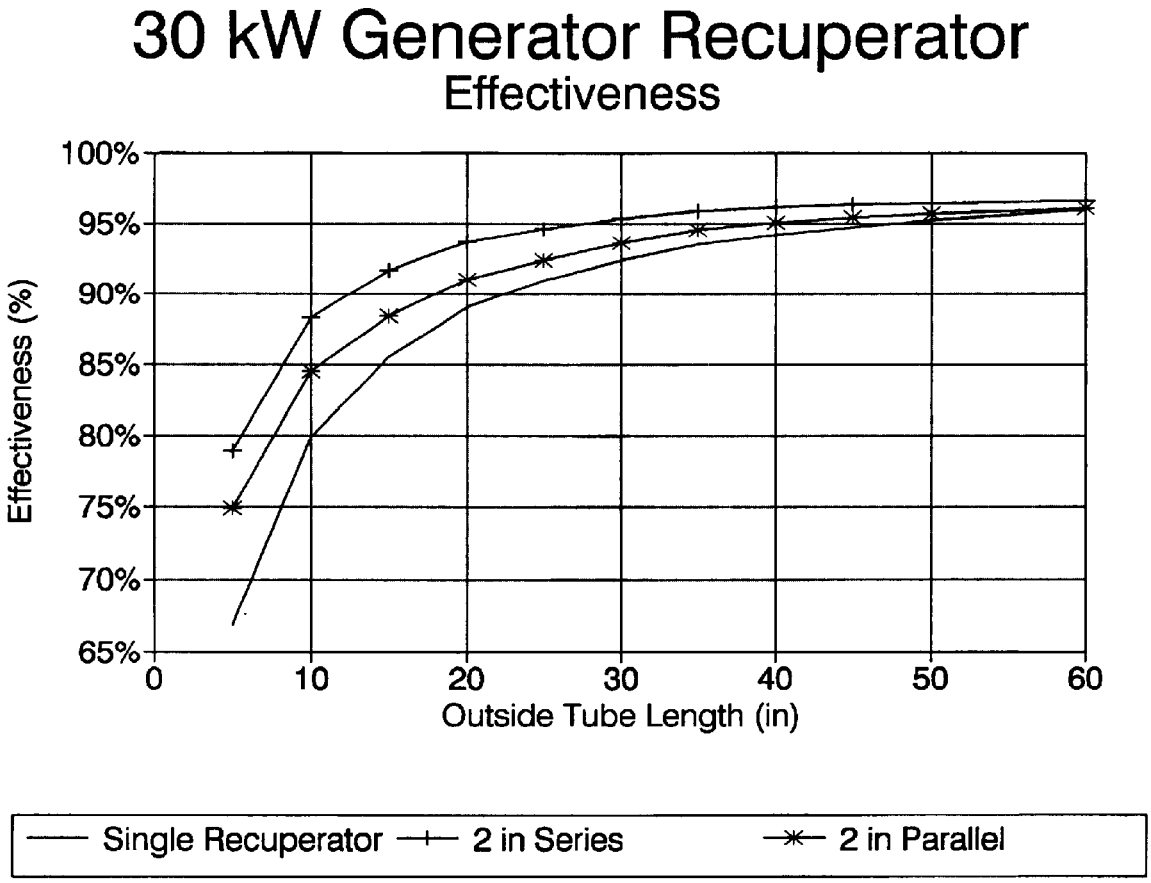
FIG. 20 shows the effectiveness of a typical recuperator as a function of tube length.
Figure 21:
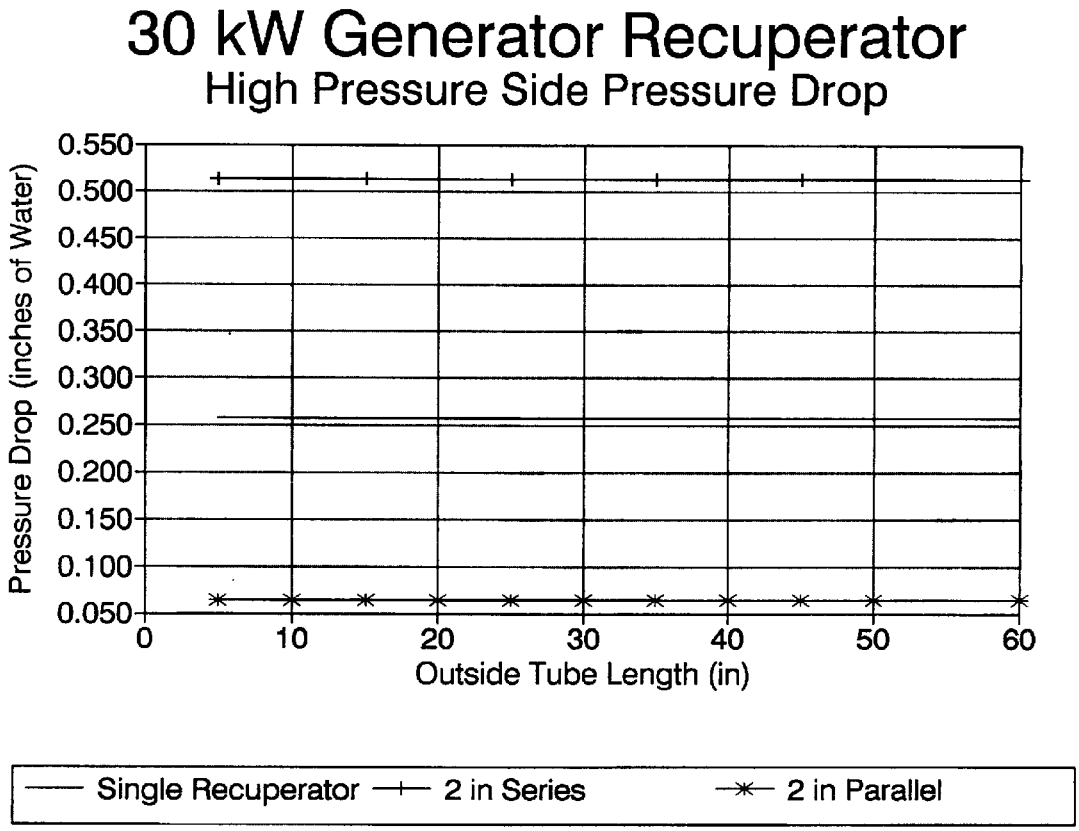
FIG. 21 shows the high pressure side pressure drop as a function of tube length for a typical recuperator.
Figure 22:
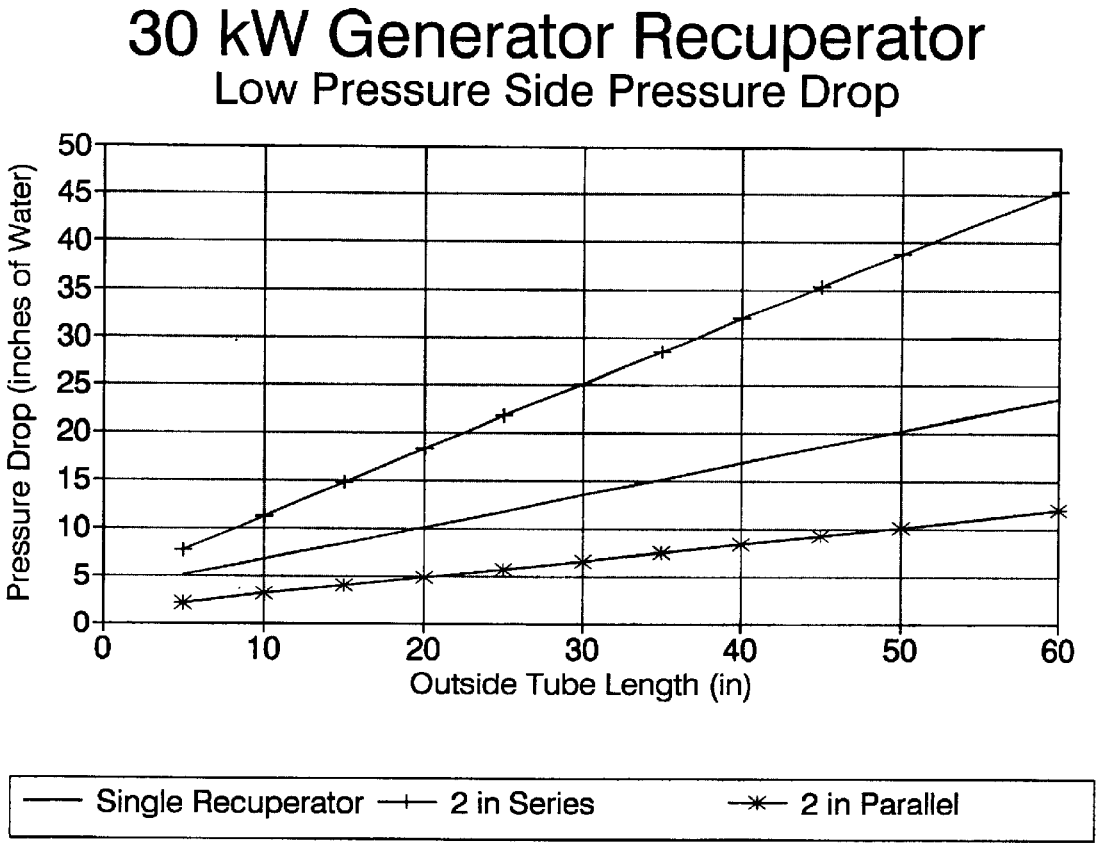
FIG. 22 shows the low pressure side pressure drop as a function of tube length for a typical recuperator.

FIG. 20 shows how the 95.3% effectiveness changes for different lengths of tubing for the single recuperator of the baseline and also for two recuperators in series and parallel. The figure shows that the recuperator could be made much shorter, with an outside tube length of only 23 inches, and still achieve an effectiveness of over 90%. For a non-stationary application, the loss of effectiveness might be a good trade for packaging or weight considerations. Two recuperators in series (FIG. 8) are more expensive but can produce an effectiveness of over 90% in a length of less than 15 inches. Corresponding high pressure side pressure drop is shown in FIG. 21 and low pressure side pressure drop is shown in FIG. 22. It can be seen that the series arrangement does not provide a significant increase in effectiveness but greatly reduces pressure drop.

Figure 23:
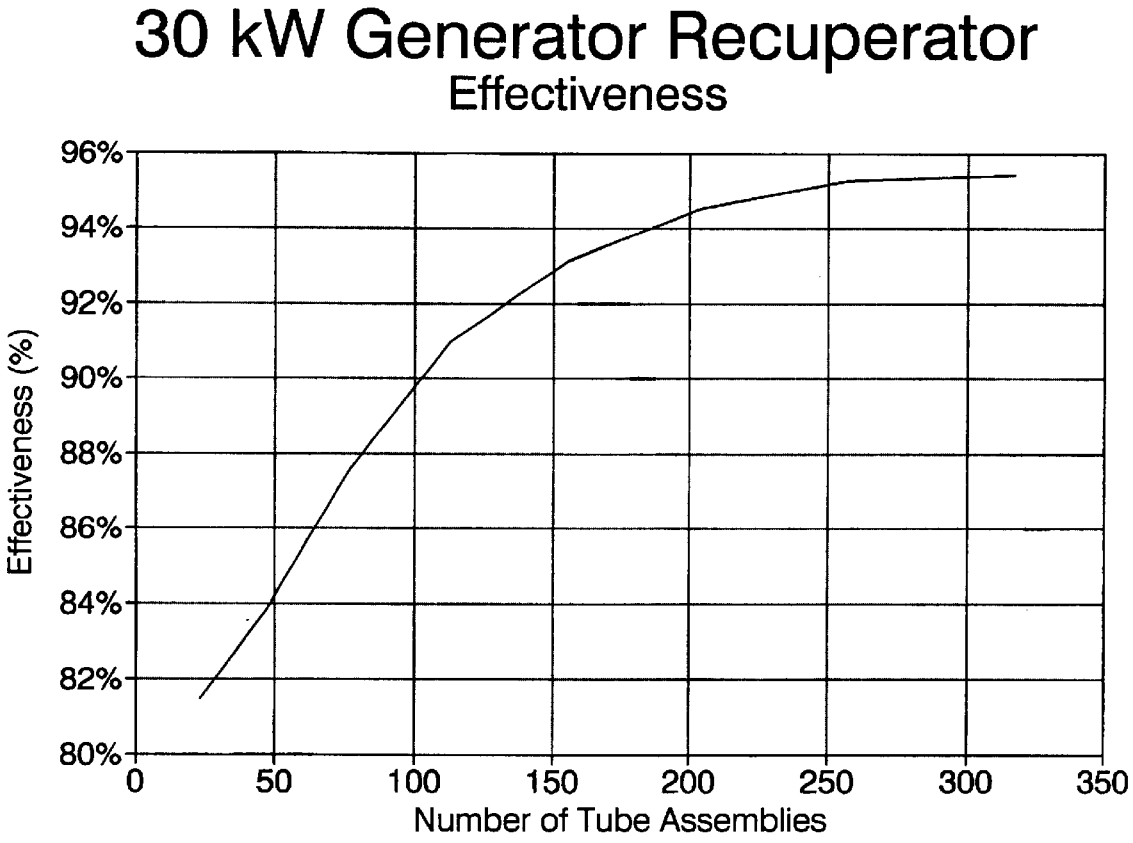
FIG. 23 shows the effectiveness as a function of number of concentric tube assemblies for a typical recuperator.
Figure 24:
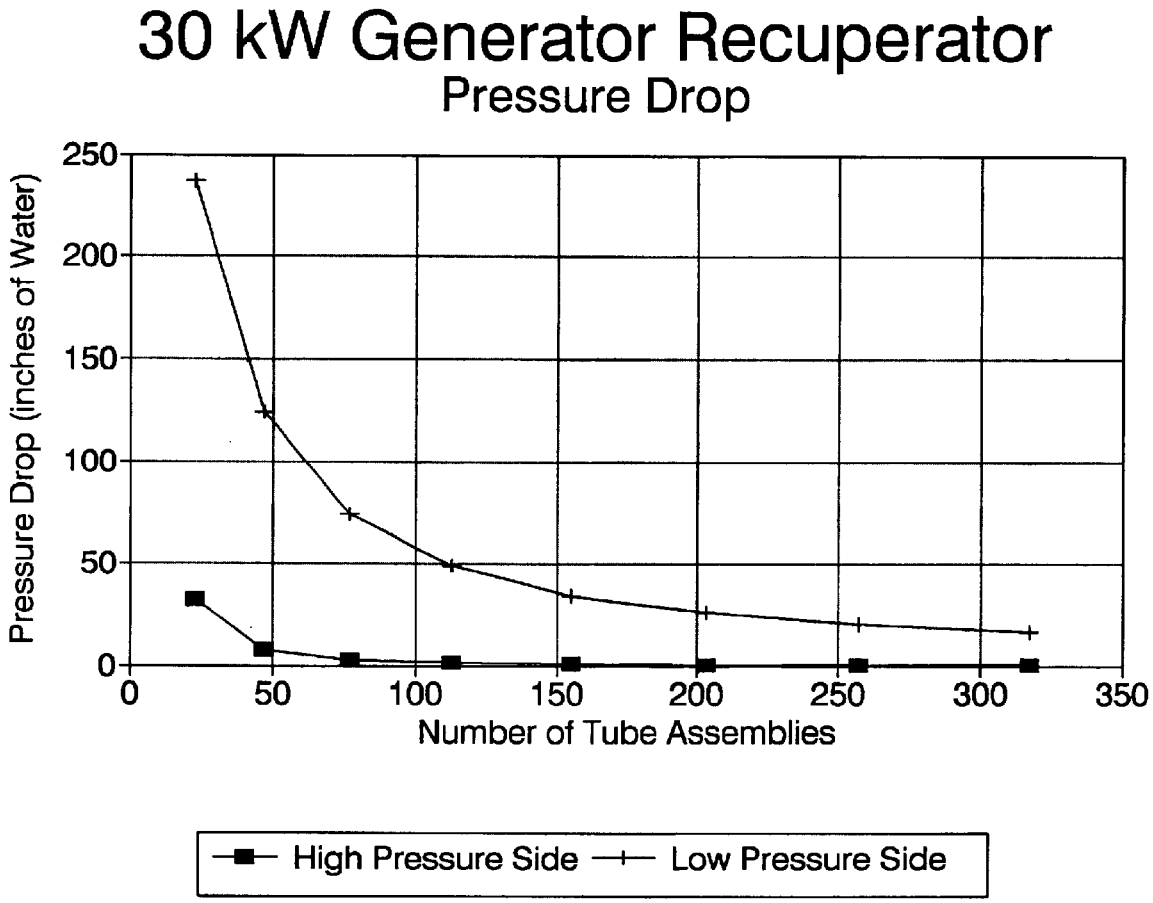
FIG. 24 shows the pressure drop for both the high and low pressure sides as a function of number of concentric tube assemblies for a typical recuperator.

FIG. 23 shows how the recuperator effectiveness changes by reducing or increasing the number of concentric tube assemblies from the baseline quantity of 257. An effectiveness of over 90% can be achieved with only 100 concentric tube assemblies and would greatly lower initial construction costs. This type of reduction would be advantageous if the fuel cost savings from the 5% effectiveness difference is less important than initial cost or if space and weight precludes a larger recuperator. FIG. 24 shows the corresponding pressure drops.

Figure 25:
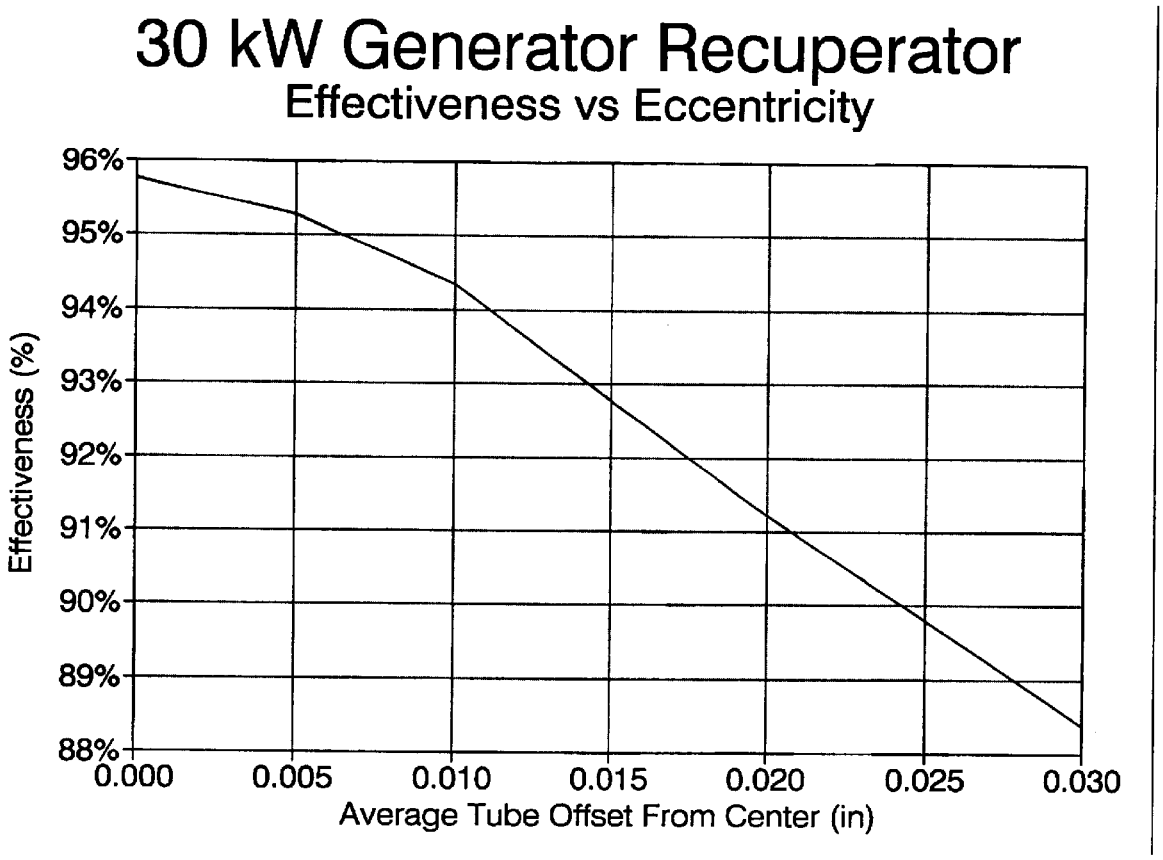
FIG. 25 shows the effectiveness as a function of tube location error for a typical recuperator.
Figure 26:
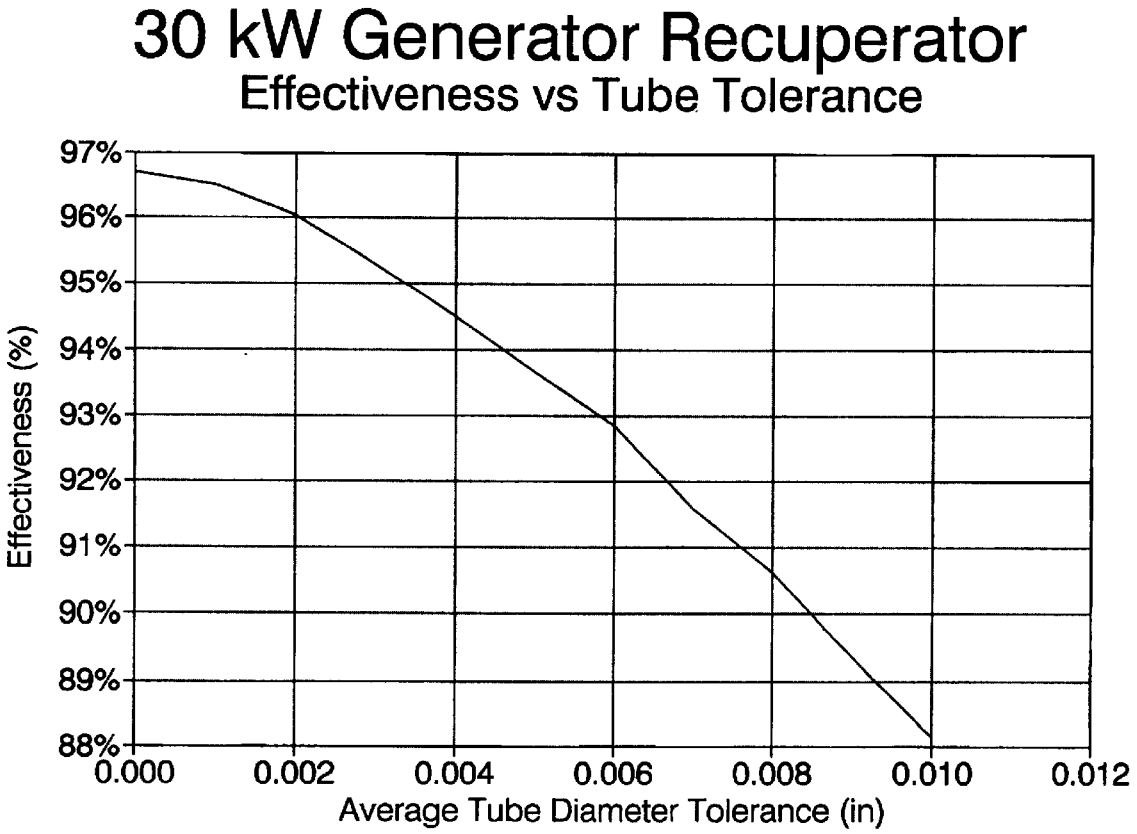
FIG. 26 shows the effectiveness as a function of tube diameter tolerance error for a typical recuperator.

The effect of manufacturing accuracy is demonstrated in FIG. 25 and FIG. 26. FIG. 25 shows how effectiveness varies with eccentricity in the concentric tube assemblies. The figure shows that good workmanship produces higher effectiveness but that the recuperator is not dependent on extremely close tolerances. Effectiveness of over 90% can be achieved with all the tubes being eccentric by up to 0.024". The similar case for tube diameter tolerance is shown in FIG. 26. Again, high tolerance produces higher effectiveness but tube sizes varying by 0.008" still produce a recuperator with over 90% effectiveness.

Figure 27:
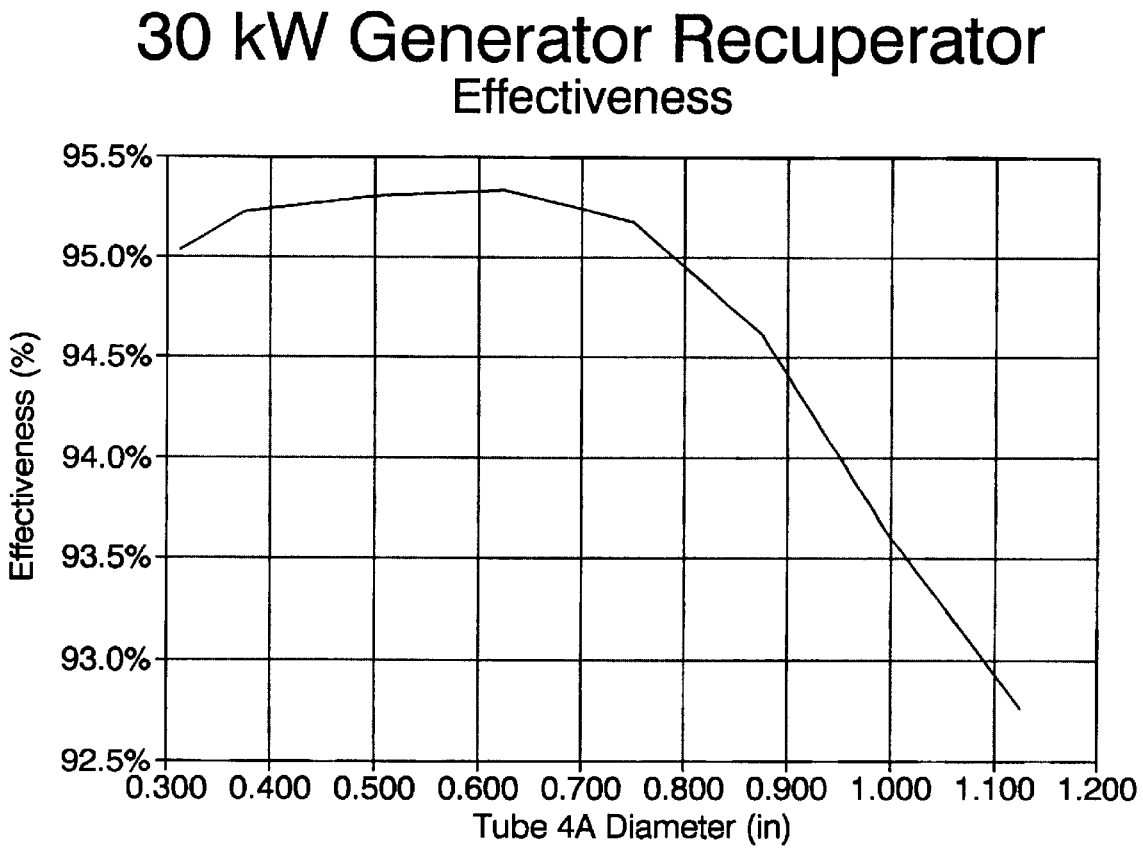
FIG. 27 shows the effectiveness as a function of tube diameter for a typical recuperator.
Figure 28:
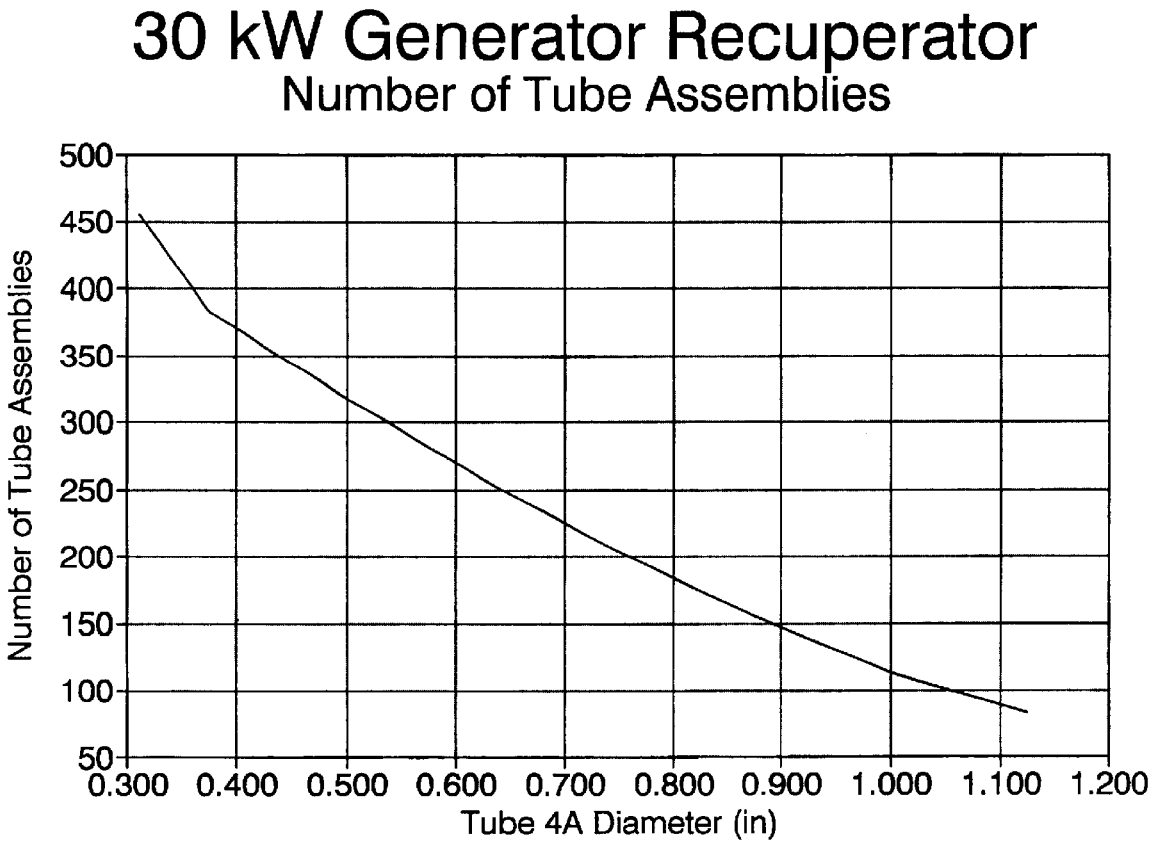
FIG. 28 shows the number of tube assemblies as a function of tube diameter for a typical recuperator.
Figure 29:
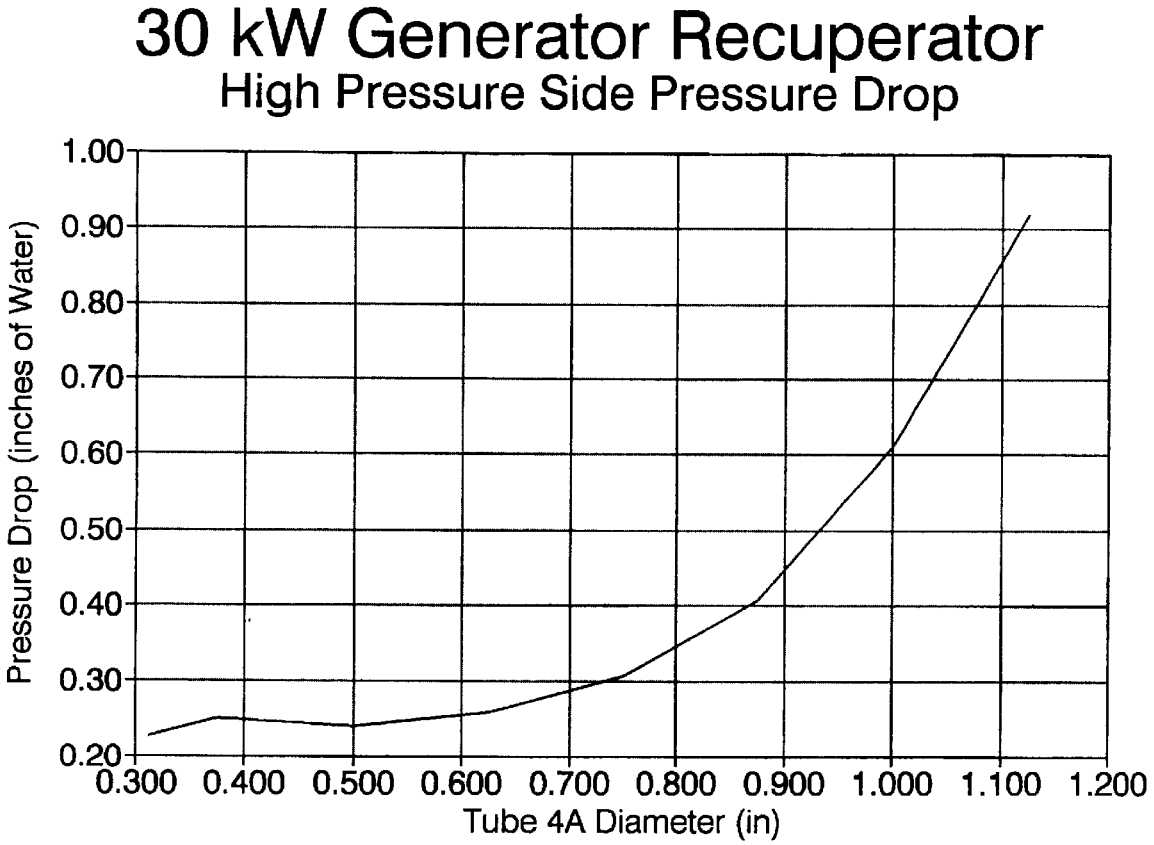
FIG. 29 shows the high pressure side pressure drop as a function of tube diameter for a typical recuperator.
Figure 30:
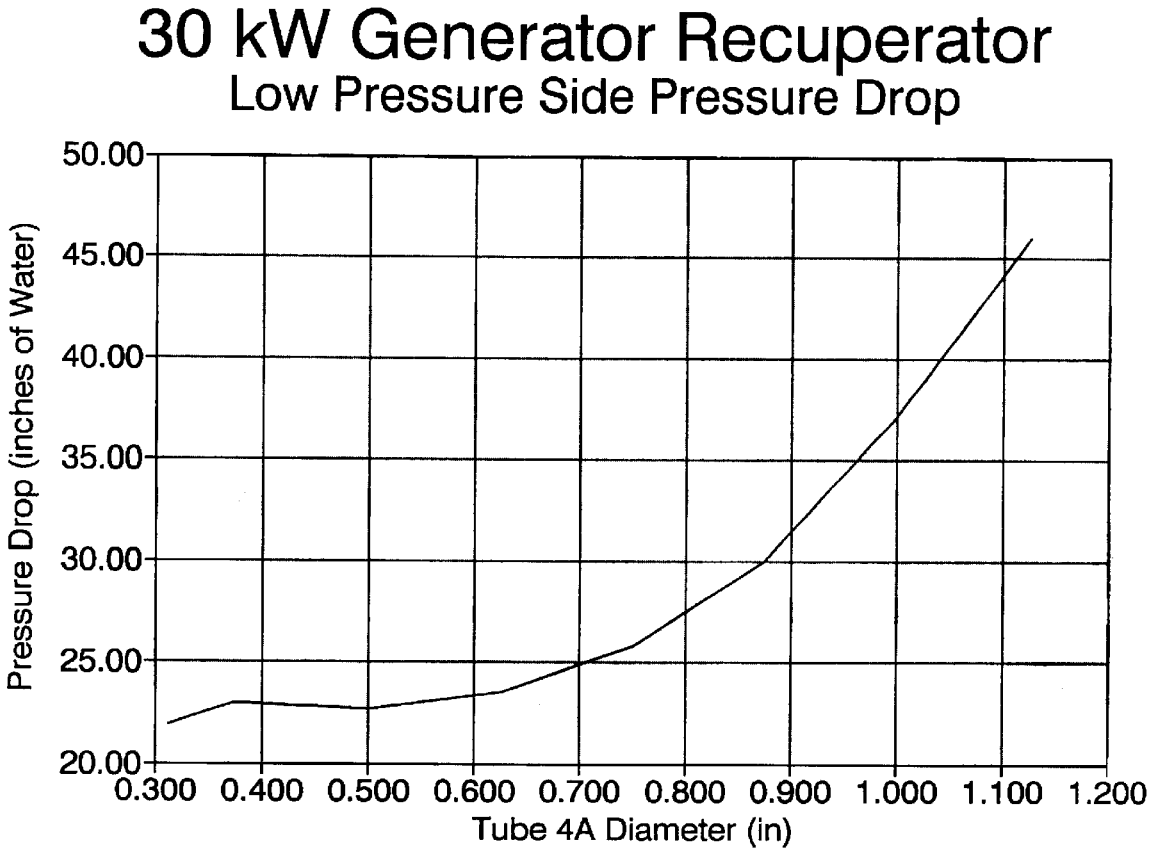
FIG. 30 shows the low pressure side pressure drop as a function of tube diameter for a typical recuperator.

The effect of tube diameter is demonstrated in FIG. 27 though FIG. 30. In these figures, the center low pressure tube (4A or 5A in FIG. 2) is allowed to vary while the other tubes maintain the baseline ⅛" diameter difference and the wall thickness remains the same. The number of concentric tubes is adjusted so that the total heat transfer area remains the same and the header plate diameter remains at 29 inches. FIG. 27 shows that the baseline ⅝" diameter center low pressure tube is nearly optimum for effectiveness. However, increasing that center low pressure tube diameter to ¾" has a negligible reduction in effectiveness while reducing the number of concentric tube assemblies needed from 250 to 200. As can be seen from the corresponding pressure drop plots in FIG. 29 and FIG. 30, the change in tube size also has only a slight pressure drop penalty. A designer would probably make this change from the baseline. Increasing the tube diameters to even larger sizes can reduce the number of concentric tube assemblies to less that 100 if the loss of effectiveness and increased pressure drop still meet the overall engine requirements.

Figure 31:
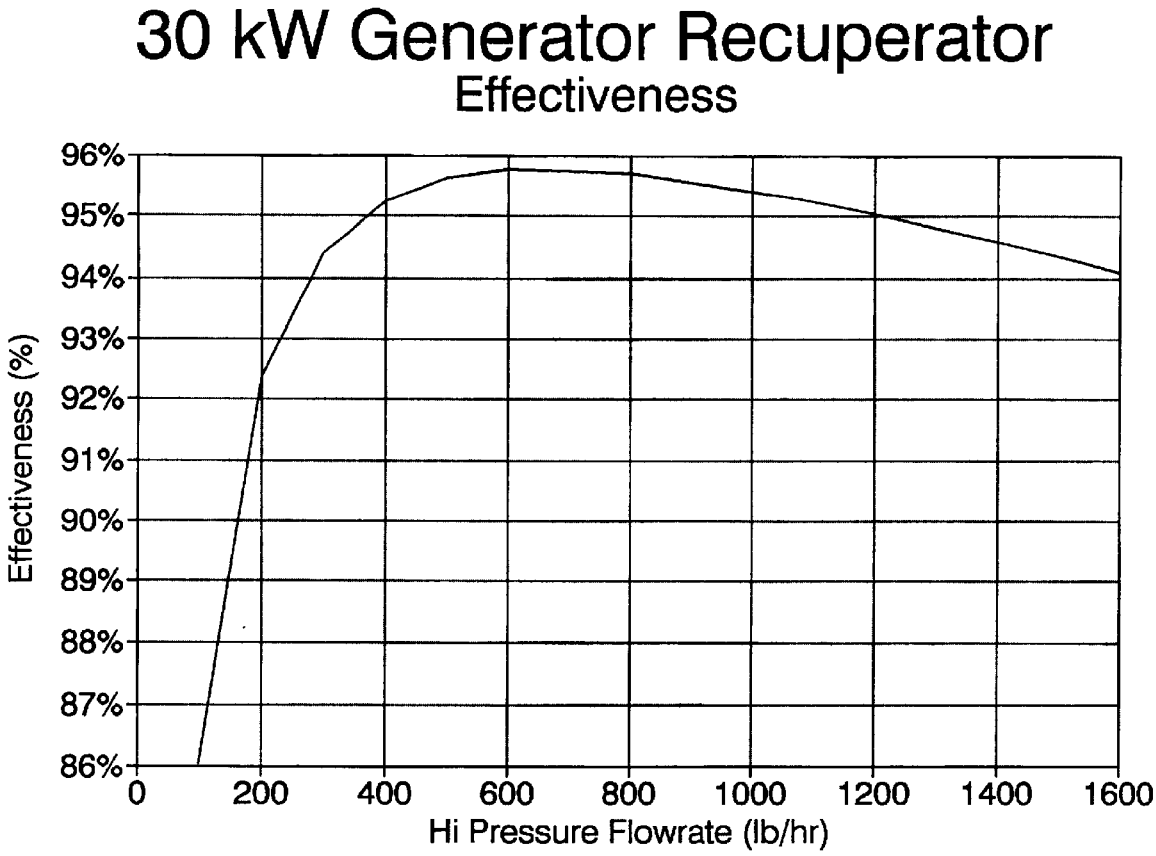
FIG. 31 shows the effectiveness as a function of flowrate for a typical recuperator.
Figure 32:
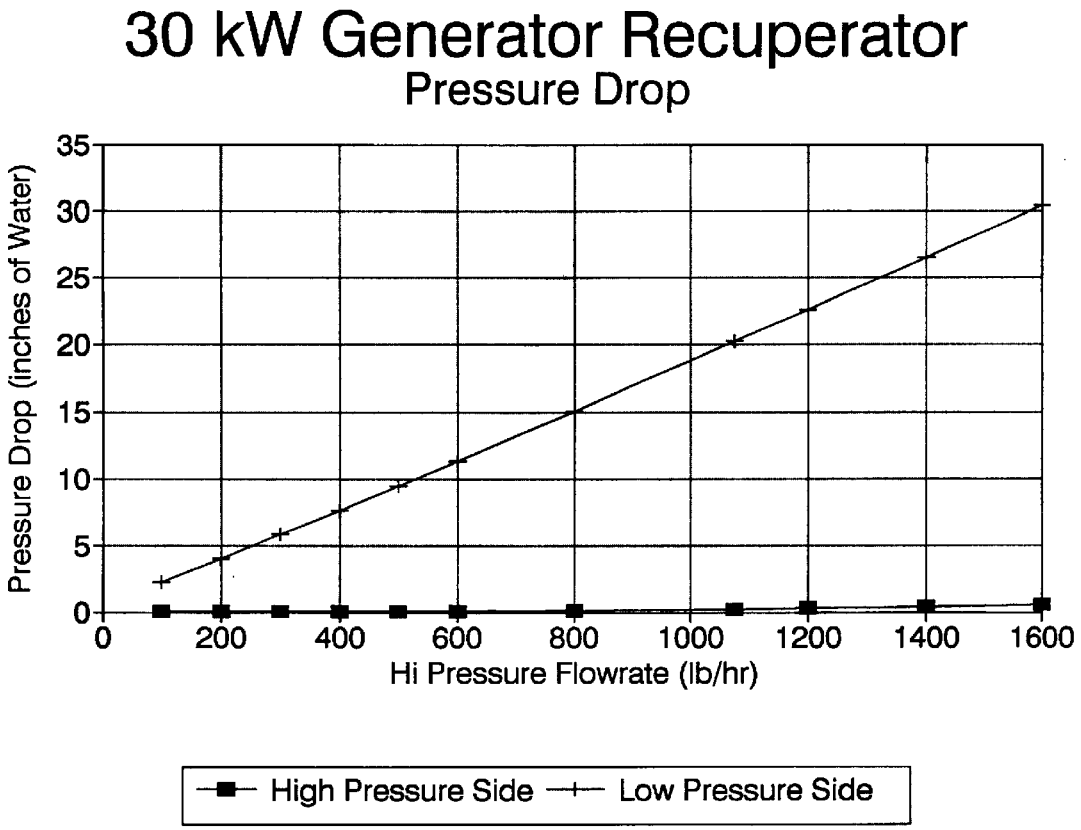
FIG. 32 shows the pressure drop as a function of flowrate for a typical recuperator.

The final two figures, FIG. 31 and FIG. 32 show how the baseline recuperator performance changes with the high pressure flowrate when the generator is run at power levels different from nominal. At flowrates above 600 pounds/hour the constant UA of the laminar flow passages causes the effectiveness to increase as the flowrate decreases. However, when the flowrate drops below 600 pounds/hour, the effectiveness rapidly decreases with reduced flow. This is due to the flowrate being reduced so much that the longitudinal conduction in the concentric tube assemblies and the heat loss through the insulation to ambient become proportionally more significant at the lower flowrates. Nevertheless, the effectiveness remains at very high values over a wide range of flows. Therefore, the generator efficiency will remain high even when run at partial loads or if the load increases to meet peak power requirements.

CONCLUSION, RAMIFICATIONS AND SCOPE

The previous Detailed Description of the Preferred Embodiment describes the current best means to make and operate the annular flow concentric tube recuperator. Analytical tools were presented to allow a designer to select numbers and sizes of tubes to best meet most applications where the recuperator is used as a gas turbine or Afterburning Ericsson cycle recuperator. However, there may be requirements where deviations from the above specifications can be beneficial.

As an alternative to the preferred embodiment, more than four concentric tubes could be used in the concentric tube assemblies. However, although more than four tubes makes better use of the tube surfaces for heat transfer, more tubes increases the number of header passages and makes the recuperator more complex.

As another alternative, three tubes comprising two flow paths could be considered. Normally the four tube assembly with a 2/1 ratio of low pressure to high pressure tubes is preferable because it lowers the pressure loss on the low pressure side. However, when there is little pressure difference between the high and low pressure sides, a three tube concentric tube assembly could be simpler and might be preferable for that case. Further reducing the number of tubes to a conventional, two tube, concentric tube assembly is not recommended because the heat transfer into a circular tube is not as efficient as into an annular passage unless the tube diameter is so small that pressure drop becomes excessive.

Use of wavy, finned, or otherwise enhanced surfaces is not part of the preferred embodiment but, when pressure drop is not critical, could result in a more compact recuperator if space requirements so demand. Also, although it is preferred to operate in the laminar flow regime, size or weight restrictions (particularly on large stationary powerplant installations having high mass flows) have been found to be best met by operating at the higher Reynolds Numbers of turbulent flow.

Non-circular tubes could also be used in place of the circular tubes of the preferred embodiment.

Multiple inlet and outlet flow tubes could be used to better distribute the flow into the header assembly and they could also enter through the header rings instead of the currently preferred manner of entering through the header plates.

On the low pressure side exhaust side, the low pressure flow tubes can be eliminated by perforating or even eliminating the header rings so that the exhaust flows directly out the side of the recuperator.

Obviously, the annular flow concentric tube recuperator here disclosed has many possible hardware modifications and variations. Thus the scope of the invention should be determined by the appended claims and their legal equivalents, rather than by the previous specification of the currently preferred embodiment.

I claim:

1. A counterflow heat exchanger for transferring heat between a high pressure fluid stream and a low pressure fluid stream wherein said heat transfer is through the walls of a plurality of parallel concentric tubes and wherein the number, size and length of parallel concentric tubes are selected to provide the optimal combination of both high heat transfer effectiveness and low pressure drop, said counterflow heat exchanger comprising:

a. a plurality of parallel concentric tube assemblies that are individually comprised of four concentric tubes for containing each of said two counter flowing fluid streams in three annular flow spaces formed between said four concentric tubes wherein said low pressure stream is split into two parallel flow paths contained in the inner and outer annular flow space and wherein high pressure flow is in counterflow in the middle annular flow space such that pressure drop is minimized because pressure and density differences between said two streams are mitigated by said two parallel flow paths producing a double flow area for said low pressure stream and such that heat exchange between said high pressure and low pressure streams is through the walls of said four concentric tubes, b. a header means for connecting said plurality of parallel concentric tube assemblies comprised of:

four header plates each having a number of holes equaling the number of said concentric tube assemblies wherein said holes match the diameter of one of the four concentric tubes in said concentric tube assemblies, with said holes in all four header plates being concentric, and wherein each open end of the four concentric tubes of said concentric tube assemblies is attached to a matching header plate where it protrudes through its respective hole in said matching header plate, ii. a header ring means for connecting said header plates to form three isolated manifold spaces between said header plates where each manifold space can freely communicate with a respective annular flow space in each of said concentric tube assemblies, iii. a flow means for connecting each of said manifold spaces to an outside system.

2. A method for constructing the counterflow heat exchanger of claim 1 wherein said header ring means are made in sections that can be incrementally attached to said header plates and adjoining sections of header ring means to facilitate assembly of said header means by a step-by-step procedure wherein, first, each outermost of said four concentric tubes is attached to each of said matching header plates, then by creating the first of said manifold spaces by attaching said header ring section and then by repeating the process for the remaining of said four concentric tubes, header plates and header ring sections.

3. A method for constructing the counterflow heat exchanger of claim 1 wherein at least two of said concentric tube assemblies contain centering means whereby said four concentric tubes are mechanically joined to form a single rigid assembly before being installed in said header means whereby said single rigid assembly can be used as tooling to assist in assembly of said header means by accurately locating said header plates and wherein said rigid assembly further includes slot or hole means as required for the flows to bypass the blockage caused by said centering means and whereby the use of said rigid assemblies allows the remaining tube assemblies to be accurately located by attaching them to said accurately located header plates without the need for said centering means.

* * * * *